US007597424B2

(12) United States Patent
Hirayama

(10) Patent No.: US 7,597,424 B2
(45) Date of Patent: Oct. 6, 2009

(54) PRINTHEAD SUBSTRATE, PRINTHEAD, HEAD CARTRIDGE, AND PRINTING APPARATUS

(75) Inventor: Nobuyuki Hirayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 422 days.

(21) Appl. No.: 11/568,356

(22) PCT Filed: May 27, 2004

(86) PCT No.: PCT/JP2005/010092

§ 371 (c)(1),
(2), (4) Date: Oct. 26, 2006

(87) PCT Pub. No.: WO2005/115760

PCT Pub. Date: Dec. 8, 2005

(65) Prior Publication Data

US 2007/0211095 A1 Sep. 13, 2007

(30) Foreign Application Priority Data

May 27, 2004 (JP) ..... 2004-158030
May 27, 2004 (JP) ..... 2004-158031

(51) Int. Cl.
*B41J 2/05* (2006.01)

(52) U.S. Cl. ..... 347/57; 347/10; 347/44

(58) Field of Classification Search ..... 347/57
See application file for complete search history.

(56) References Cited

U.S. PATENT DOCUMENTS 4,350,449 A 9/1982 Countryman et al. ..... 400/120
5,163,760 A 11/1992 Nardozzi ..... 400/120
5,517,229 A * 5/1996 Gunther ..... 347/211
5,886,713 A * 3/1999 Okada et al. ..... 347/14
5,952,884 A 9/1999 Ide
2003/0038617 A1 * 2/2003 Yaklin ..... 323/304

FOREIGN PATENT DOCUMENTS

| | | |
|---|---|---|
| EP | 0 545 260 | 6/1993 |
| JP | 5-31938 | 2/1993 |
| JP | 05031938 A | 2/1993 |
| JP | 11-234060 | 8/1999 |

(Continued)

OTHER PUBLICATIONS

Patent Abstracts of Japan, vol. 2000, No. 24, May 11, 2001 (corresponds to JP 2001-191531).

*Primary Examiner*—Matthew Luu
*Assistant Examiner*—Brian J Goldberg
(74) *Attorney, Agent, or Firm*—Fitzpatrick, Cella, Harper & Scinto

(57) ABSTRACT

An object of this invention is to implement higher-quality printing at a higher speed by changing an electric current value to a printing element and adjusting energy applied to the printing element in an inkjet printhead. To achieve this object, a current regulating circuit is arranged on the head substrate of an inkjet printhead of a constant electric current driving type which supplies a constant electric current to a heater. The electric current value is changed in accordance with a signal (digital signal etc.) supplied from the outside of the printhead. Energy corresponding to the electric current value is applied to the printing element from a constant electric current source corresponding to each group.

11 Claims, 16 Drawing Sheets

FOREIGN PATENT DOCUMENTS

| | | | |
|---|---|---|---|
| JP | 11234060 | A | 8/1999 |
| JP | 2000-246900 | A | 9/2000 |
| JP | 2001-191531 | | 7/2001 |
| JP | 2003-058264 | | 2/2003 |
| JP | 200358264 | A | 2/2006 |

* cited by examiner

PRINTHEAD SUBSTRATE, PRINTHEAD, HEAD CARTRIDGE, AND PRINTING APPARATUS

TECHNICAL FIELD

This invention relates to a printhead substrate, printhead, head cartridge, and printing apparatus and, more particularly, to a printhead substrate, containing a circuit for driving a printing element by sending a predetermined electric current, which is used to print in accordance with an inkjet method, printhead, head cartridge, and printing apparatus.

BACKGROUND ART

An inkjet printhead (to be referred to as a printhead hereinafter), which generates thermal energy by sending an electric current to a heater arranged in the nozzle so as to discharges ink, has conventionally been known.

This printhead is a printhead which employs a method of bubbling ink near the heater by using the generated thermal energy, and discharging ink from the nozzle to print.

In order to print at a high speed, heaters (printing elements) mounted in a printhead are desirably concurrently driven as many as possible to discharge ink at the same timings. However, due to the limited capacity of the power supply of a printing apparatus having the printhead and a voltage drop caused by the resistance of a wiring line extending from the power supply to the heater, a current value which can be supplied at once is limited. For this reason, a time divisional driving method of time-divisionally driving a plurality of heaters to discharge ink is generally adopted. For example, a plurality of heaters are divided into a plurality of groups, and time divisional control is so executed as not to concurrently drive two or more heaters in each group. This can suppress a total electric current flow through heaters and eliminate the need to supply large power at once.

FIG. 13 is a circuit diagram showing an example of the arrangement of a heater driving circuit mounted in a conventional inkjet printhead.

The heater driving circuit shown in FIG. 13 is configured by mounting x heaters in each of m groups so as to concurrently drive one heater in each group, i.e., a total of m heaters, perform this operation x times, and complete driving of one cycle.

As shown in FIG. 13, MOS transistors 1102-11 to **1102-*mx* corresponding to respective heaters 1101-11 to 1101-*mx* are divided into m groups 1100-1 to 1100-*m* which contain the same number of (x) MOS transistors. More specifically, in the group 1100-1, a power supply line from a power supply pad 1103 (power source terminal) is commonly connected to the heaters 1101-11 to 1101-1*x*, and the MOS transistors 1102-11 to 1102-1*x* are series-connected to the corresponding heaters 1101-11 to 1101-1*x* between the power supply pad 1103 and ground (GND) 1104**.

When a control signal is supplied from a control circuit 1105 to the gates of the MOS transistors 1102-11 to **1102-1*x*, the MOS transistors 1102-11 to 1102-1*x* are turned on so that an electric current can flow from the power supply line through corresponding heaters and the heaters 1101-11 to 1101-1*x*** are heated.

FIG. 14 is a timing chart showing a timing at which an electric current is sent to drive heaters in each group of the heater driving circuit shown in FIG. 13. FIG. 14 exemplifies the group 1100-1 in FIG. 13.

In FIG. 14, control signals VG1 to VGx are timing signals for driving the first to x-th heaters 1101-11 to **1101-1*x* belonging to the group 1100-1. More specifically, the control signals VG1 to VGx represent the waveforms of signals input to the control terminals (gates) of the MOS transistors 1102-11 to 1102-1*x* of the group 1100-1. A corresponding MOS transistor 1102-1*i* (i=1, x) is turned on for a high-level control signal, and a corresponding MOS transistor is turned off for a low-level control signal. This also applies to the remaining groups 1100-2 to 1100-*m*. In FIG. 14, Ih1 to Ihx represent current values flowing through the heaters 1101-11 to 1101-1*x***.

In this manner, heaters in each group are sequentially and time-divisionally driven by sending an electric current. The number of heaters driven in each group by sending an electric current can always be controlled to one or less, and no large electric current need be supplied to a heater substrate.

FIG. 15 is a view showing the layout (actual arrangement) of power supply lines connected from the power supply pad 1103 to the groups 1100-1 to **1100-*m* shown in FIG. 13**.

As shown in FIG. 15, power supply lines 1301-1 to **1301-*m* are individually connected from the power supply pad 1103 to the respective groups 1100-1 to 1100-*m*, and power supply lines 1302-1 to 1302-*m* are connected to the ground (GND) pad 1104**. In a printhead having m x x heaters (printing elements), time divisional driving of sequentially driving one printing element in each group requires m power supply lines and m ground lines.

As described above, by keeping the maximum number of concurrently drivable heaters in each group to "one", a current value flowing through a wiring line divided for each group can always be suppressed to be equal to or smaller than a current flowing through one heater. Even when a plurality of heaters are concurrently driven, voltage drop amounts on wiring lines on the heater substrate can substantially be made constant. At the same time, even when a plurality of heaters are concurrently driven, the amounts of energy applied to respective heaters can be made almost constant.

Recently, printing apparatuses require higher speeds and higher precision, and a mounted printhead integrates a larger number of nozzles at a higher density. Heaters are required to be simultaneously driven as many as possible in view of improving the printing speed.

A printhead substrate (to be referred to as a head substrate hereinafter) which integrates heaters and their driving circuit is prepared by forming many heaters and their driving circuit on the same semiconductor substrate. For the purpose of reducing the production cost, in the manufacturing process, the number of heater substrates formed from one semiconductor wafer must be increased, and downsizing of the head substrate is also demanded.

When, however, the number of concurrently driven heaters is increased, as described above, the head substrate requires wiring lines corresponding to the number of concurrently driven heaters. As the number of wiring lines increases, the wiring width per wiring line decreases to increase the wiring resistance when the area of the head substrate is limited. Further, each wiring width decreases, and variations in resistance between wiring lines on the head substrate increase. This problem occurs also when the head substrate is downsized, and the wiring resistance and variations in resistance increase. Since heaters and power supply lines are series-connected to the power supply on the head substrate, as described above, increases in wiring resistance and variations in resistance lead an increase in the variation of a voltage applied to each heater.

When energy applied to a heater is too small, ink discharge becomes unstable; when the energy is too large, the heater durability degrades. In other words, in a case where the variation of the voltage applied to heaters is large, the heater durability degrades or ink discharge becomes unstable. For this reason, to print with high quality, energy applied to a heater is desirably constant. Furthermore, it is also desirable to stably apply appropriate energy in view of the durability.

In the above-described time divisional driving where the number of concurrently driven heater is one or less, the voltage drop can be suppressed within the head substrate. However, since a wiring line outside the head substrate is common to a plurality of heaters of plural groups, the amount of voltage drop on the common wiring line changes depending on the number of concurrently driven heaters. In order to make energy applied to each heater constant against variations in the above voltage drop, energy applied to each heater is conventionally adjusted by the voltage application time. However, as the number of concurrently driven heaters increases, a current flowing through a common wiring line generates a large amount of voltage drop. As a result, the voltage applied to a heater decreases. The voltage application time in heater driving must be prolonged to compensate for the voltage drop, and this makes it difficult to drive a heater at a high speed.

Taking into consideration the above background and problems to be solved, it is desirable to employ a method in which a constant electric current is supplied to each heater so that energy to be applied to each heater is made constant.

As a method which solves such problems caused by variations in energy applied to a heater, for example, Japanese Patent Publication Laid-Open No. 2001-191531 proposes a method of driving a printing element by a constant current.

FIG. 16 is a circuit diagram showing a heater driving circuit disclosed in Japanese Patent Laid-Open No. 2001-191531.

In this arrangement, printing elements (R1 to Rn) are driven by a constant current using constant current sources (Tr14 to Tr($n$+13)) and switching elements (Q1 to Qn) which are arranged for the respective printing elements (R1 to Rn).

DISCLOSURE OF INVENTION

Accordingly, the present invention is conceived as a response to the above-described disadvantages of the conventional art.

For example, a printhead substrate, a printhead integrating the printhead substrate, a head cartridge integrating the printhead, and a printing apparatus using the printhead according to the present invention are capable of supplying a predetermined constant current to each printing element to drive it at a high speed.

According to one aspect of the present invention, preferably, there is provided a printhead substrate comprising: a plurality of printing elements; a constant electric current source which generates a constant electric current used to drive the plurality of printing elements; a reference current generation circuit which generates in accordance with an externally input logic signal a reference current for generating the constant electric current; and a driving circuit which drives the plurality of printing elements by the constant electric current obtained by driving the constant electric current source in accordance with the reference current generated by the reference current generation circuit.

The plurality of printing elements desirably include: a plurality of heaters; and driving elements which are arranged in correspondence with the respective heaters and drive the heaters, the plurality of heaters and the driving elements are divided into a plurality of groups, and the constant electric current source which supplies the constant electric current is arranged in correspondence with each group.

The reference current generation circuit preferably includes: an n-bit shift register which receives and temporarily stores an n-bit logic signal; a latch circuit which latches the n-bit logic signal stored in the n-bit shift register; n driving circuits which generate electric currents of different levels; and an output circuit which outputs as the reference current a sum of the electric currents generated by the n driving circuits, and the n driving circuits are selectively driven in accordance with the n-bit logic signal output from the latch circuit.

In this case, preferably, the levels of the electric currents generated by the n driving circuits are weighted by ½ each in a descending order from a maximum level of the electric current, and the reference current as the sum of the electric currents is changeable at $2^n$ levels.

The reference current generation circuit may include: an n-bit shift register which receives and temporarily stores an n-bit logic signal; a latch circuit which latches the n-bit logic signal stored in the n-bit shift register; a voltage regulating circuit which is configured to output voltages of $2^n$ levels in accordance with the n-bit logic signal output from the latch circuit; and a voltage-to-current conversion circuit which converts the voltage from the voltage regulating circuit and outputs the reference current.

The reference current generation circuit and the constant electric current'source desirably form a current mirror circuit.

The reference voltage circuit preferably employs a voltage obtained by amplifying a band-gap voltage as the reference voltage.

The constant electric current source is preferably comprised of a MOS transistor operable in a saturated region where a variation of a drain current is smaller than that of a drain voltage.

The printing elements, switching elements and the constant electric current sources in order are arranged in a direction of a higher potential wiring to a lower potential wiring.

According to another aspect of the present invention, preferably, there is provided a printhead substrate comprising: a plurality of heaters; a plurality of printing elements which are arranged in correspondence with the respective heaters and respectively includes driving elements for driving the respective heaters; a control circuit for driving the plurality of printing elements by dividing the plurality of printing elements into a plurality of groups, each containing one or less concurrently driven printing element; a constant electric current source which is arranged in correspondence with each group and generates a constant electric current used to drive the printing elements; and a reference current generation circuit which generates a reference current to be supplied to the constant electric current source in accordance with a voltage or an electric current input from outside to change a constant electric current value generated by the constant electric current source.

Preferably, the reference current generation circuit comprises a plurality of current mirror circuits, and the plurality of current mirror circuits generate a plurality of reference currents in accordance with the input voltage or current.

Other current mirror circuits preferably supply the reference current generated by the reference current generation circuit to a plurality of constant electric current sources.

The constant electric currents from the plurality of constant electric current sources are supplied to respective printing element groups formed from the plurality of heaters and the plurality of driving elements.

The printing element, a switching element, the constant electric current source are preferably series-connected.

According to still another aspect of the present invention, preferably, there is provided a printhead using a printhead substrate having the above arrangement.

The printhead desirably includes an inkjet printhead which prints by discharging ink.

According to still another aspect of the present invention, preferably, there is provided a head cartridge integrating the above inkjet printhead and an ink tank containing ink to be supplied to the inkjet printhead.

According to still another aspect of the present invention, preferably, there is provided a printing apparatus for discharging ink into a printing medium for printing by using an inkjet printhead or head cartridge having the above arrangement.

The invention is particularly advantageous since generation of a reference current is controlled using a logic signal from the printing apparatus main body for an electric current supplied to the printing element, and the same logic signal as a control signal for selectively driving the printing elements of the printhead by the printing apparatus main body can be used. No interface circuit associated with current control need be newly interposed between the printing apparatus main body and the printhead, suppressing an increase in the cost of the printing apparatus main body.

Since the control signal which is supplied externally, e.g., from the printing apparatus main body and used to regulate an electric current is a logic signal, even an inkjet printhead substrate which suffers large variations in electric current value upon driving/non-driving of a heater exhibits a higher noise tolerance to a control signal and can reduce malfunctions in current regulating control in comparison with current control using an analog signal.

Based on the reference current, a constant electric current can be supplied to each printing element to drive it. Constant energy can be applied to the printing element without regulating the voltage application time, unlike the conventional case, and printing can be done at a higher speed. Further, high-quality printing can be implemented without any printing error caused by a voltage drop, unlike the conventional case.

In view of another aspect, the reference current can be generated on the basis of an externally input voltage or electric current value.

By using the reference current, a constant electric current can be supplied to each printing element to drive it. Constant energy can be applied to the printing element without regulating the voltage application time, unlike the conventional case, and printing can be done at a higher speed.

Other features and advantages of the present invention will be apparent from the following description taken in conjunction with the accompanying drawings, in which like reference characters designate the same or similar parts throughout the figures thereof.

BRIEF DESCRIPTION OF DRAWINGS

The accompanying drawings, which are incorporated in and constitute a part of the specification, illustrate embodiments of the invention and, together with the description, serve to explain the principles of the invention.

BEST MODE FOR CARRYING OUT THE INVENTION

Preferred embodiments of the present invention will now be described in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

The following printhead substrate (head substrate) means not only a base merely made of a silicon semiconductor but also a base having elements, wiring lines, and the like.

Furthermore, the term "on a substrate" means not only "on a head substrate", but also "the surface of a head substrate" or "inside a head substrate near the surface". The term "built-in" in the present invention does not represent that each separate element is arranged as a separate member on a substrate surface, but represents that each element is integrally formed and manufactured on a head substrate by a semiconductor circuit manufacturing process or the like.

The term "constant electric current" and "constant electric current source" means a predetermined constant electric current to be supplied to a printing element regardless of a variation on a number of concurrently driven printing element (s) or the like and an electric current source which supplies the electric current. The value of the electric current which is expected to be constant also includes a case where it is variably set to a predetermined electric current value.

<Brief Description of Apparatus Main Unit (FIG. 1)>

Figure 1:
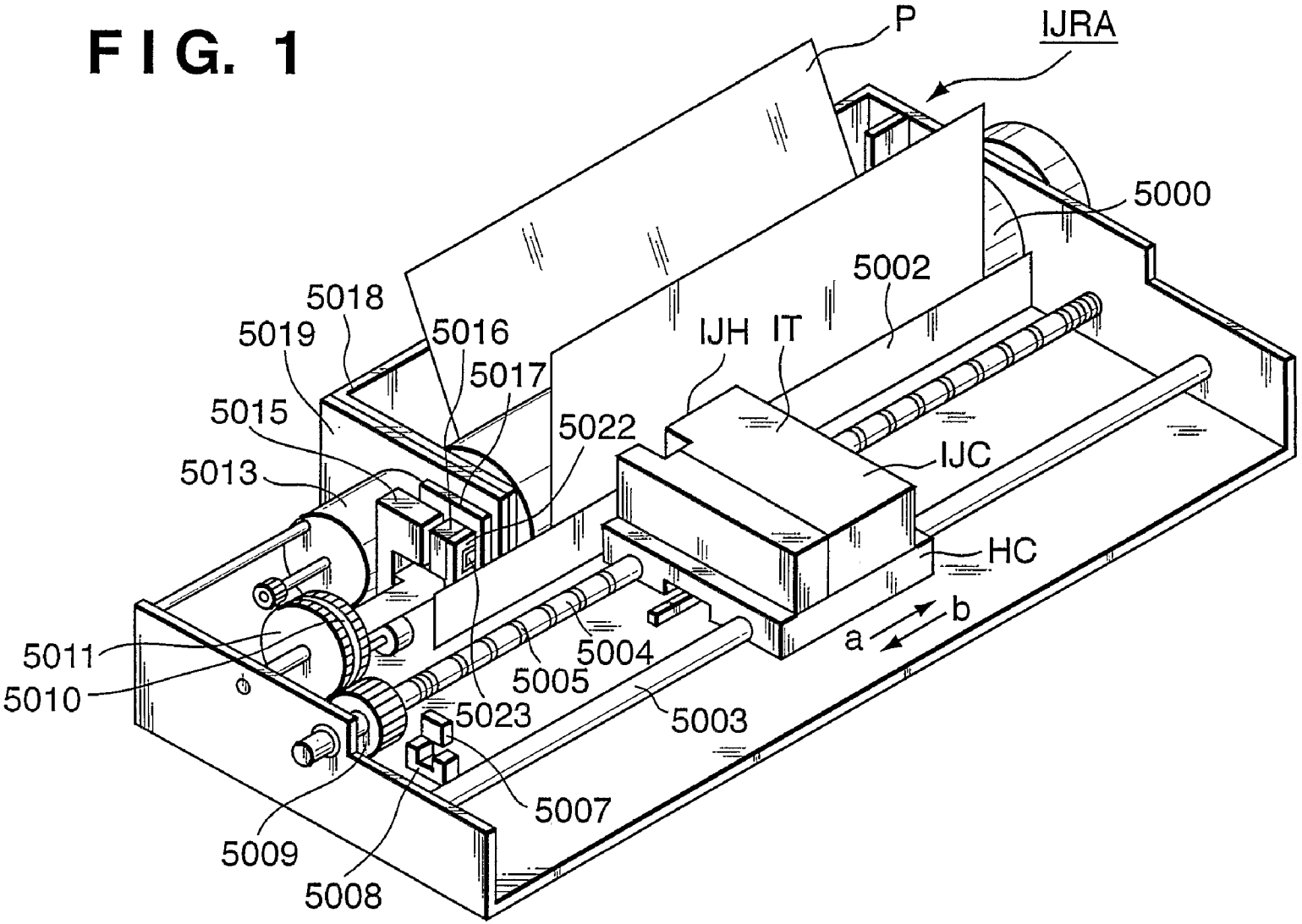
FIG. 1 is an outer perspective view showing a schematic arrangement around the carriage of an inkjet printing apparatus as a typical embodiment of the present invention.

FIG. 1 is a perspective view showing the outer appearance of an inkjet printing apparatus as a typical embodiment of the present invention. Referring to FIG. 1, a carriage HC engages with a spiral groove 5004 of a lead screw 5005, which rotates via driving force transmission gears 5009 to 5011 upon forward/reverse rotation of a driving motor 5013. The carriage HC has a pin (not shown), and is reciprocally scanned in the directions of arrows a and b in FIG. 1. An inkjet cartridge IJC which incorporates an inkjet printhead IJH (hereinafter referred to as "printhead") and an ink tank IT for containing ink is mounted on the carriage HC.

The inkjet cartridge IJC integrally includes the printhead IJH and the ink tank IT.

Reference numeral 5002 denotes a sheet pressing plate, which presses a paper sheet against a platen 5000, ranging from one end to the other end of the scanning path of the carriage. Reference numerals 5007 and 5008 denote photocouplers which serve as a home position detector. Reference numeral 5016 denotes a member for supporting a cap member 5022, which caps the front surface of the printing head IJH; and 5015, a suction device for sucking ink residue through the interior of the cap member. The suction device 5015 performs suction recovery of the printing head via an opening 5023 of the cap member 5015. Reference numeral 5017 denotes a cleaning blade; 5019, a member which allows the blade to be movable in the back-and-forth direction of the blade. These members are supported on a main unit support plate 5018.

The capping, cleaning, and suction recovery operations are performed at their corresponding positions upon operation of the lead screw 5005 when the carriage reaches the home-position side region. However, the present invention is not limited to this arrangement as long as desired operations are performed at known timings.

Figure 2:
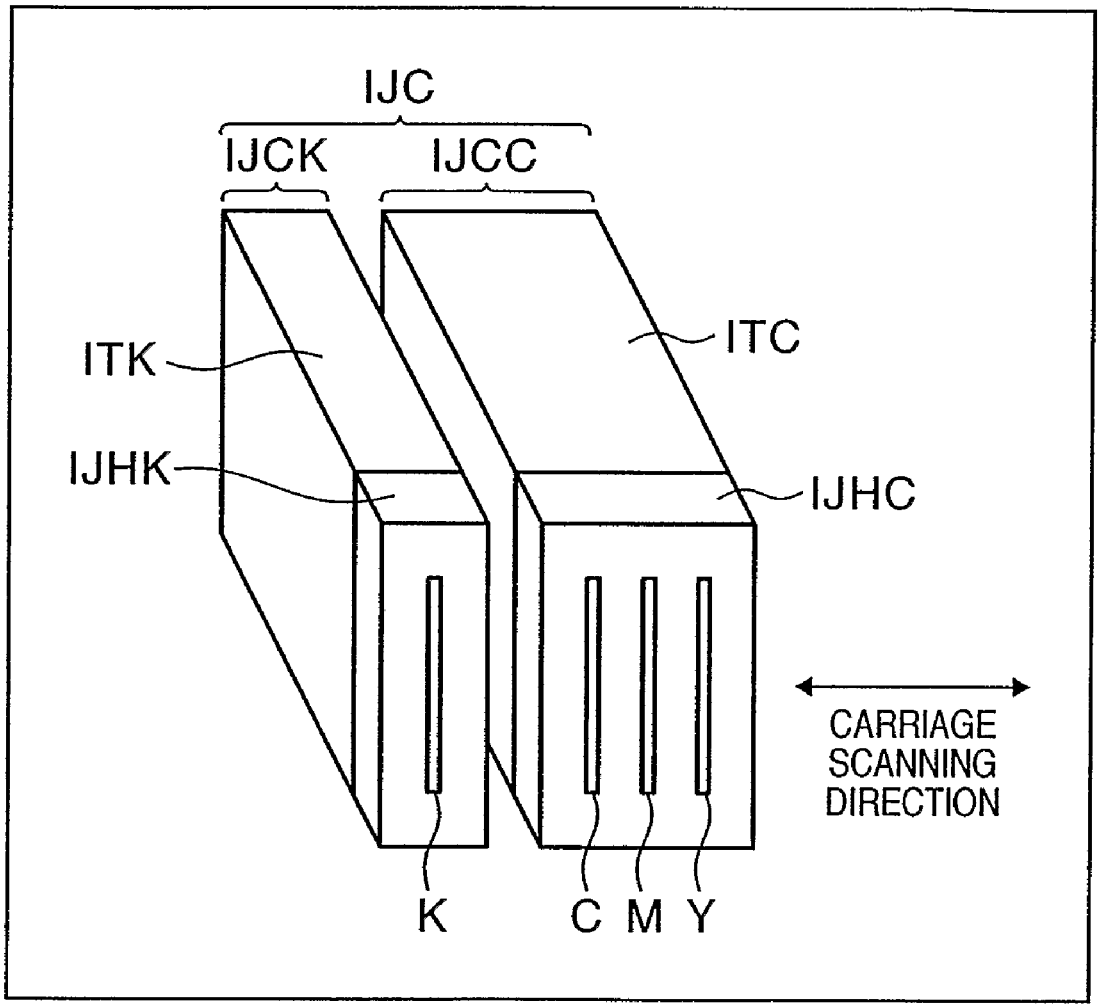
FIG. 2 is an outer perspective view showing the detailed arrangement of an inkjet cartridge IJC.

FIG. 2 is a perspective view showing a detailed outer appearance of the configuration of an inkjet cartridge IJC.

As shown in FIG. 2, the inkjet cartridge IJC is comprised of a cartridge IJCK that discharges black ink and a cartridge IJCC that discharges three colors of ink, cyan (C), magenta (M) and yellow (Y). These two cartridges are mutually separable, with each being independently detachably mounted on the carriage HC.

The cartridge IJCK is comprised of an ink tank ITK that contains black ink and a printhead IJHK that prints by discharging black ink, combined in an integrated structure. Similarly, the cartridge IJCC is comprised of an ink tank ITC that contains ink of three colors, cyan (C), magenta (M) and yellow (Y), and a printhead IJHC that prints by discharging ink of these colors, combined in an integrated structure. Note that it is assumed that the cartridge in this embodiment is a cartridge in which ink is filled in the ink tank.

The cartridges IJCK and IJCC are not limited to the integrated-type, and the ink tank and printhead may be separable.

The printhead IJH is used to generally refer to the printheads IJHK and IJHC together.

Further, as can be appreciated from FIG. 2, an array of nozzles that discharges black ink, an array of nozzles that discharges cyan ink, an array of nozzles that discharges magenta ink and an array of nozzles that discharges yellow ink are aligned in a direction of movement of the carriage, the arrayed direction of the nozzles being disposed diagonal to the carriage movement direction.

Figure 3:
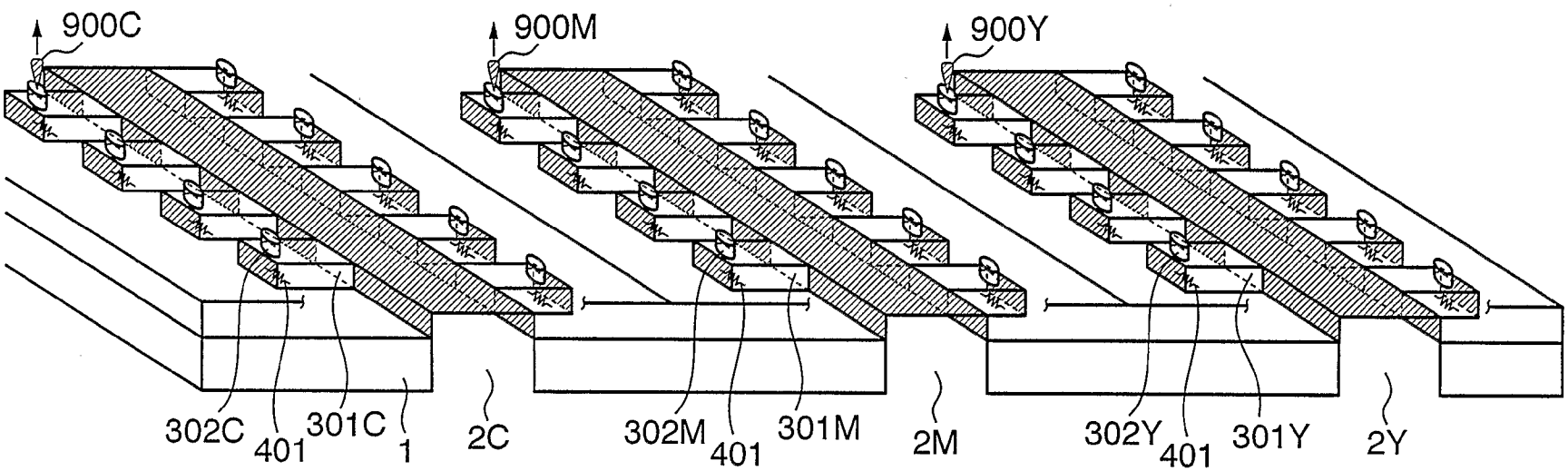
FIG. 3 is a perspective view showing part of the three-dimensional structure of a printhead IJHC which discharges ink.

FIG. 3 is a perspective view showing part of a three-dimensional structure of a printhead that discharges ink.

FIG. 3 exemplifies two nozzles which receive cyan (C) ink and discharge ink droplets. The number of nozzles is generally much larger, and this structure also applies to the remaining color inks.

The printhead IJHC has an ink channel 2C that supplies cyan (C) ink, an ink channel (not shown) that supplies magenta (M) ink, and an ink channel (not shown) that supplies yellow (Y) ink.

Particularly, FIG. 3 reveals the flow of cyan (C) ink supplied from the ink tank ITC.

As shown in FIG. 3, the ink flow path 301C is provided in correspondence to electrothermal transducers (heaters) 401. The cyan ink that pass through the ink flow path 301C is led to electrothermal transducers (that is, heaters) 401 provided on the substrate. Then, when the electrothermal transducers (heaters) 401 are activated via circuits to be described later, the ink on the electrothermal transducers (heaters) 401 is heated, the ink boils, and, as a result, ink droplet 900C is discharged from the orifice 302C by the bubble that arises.

In the arrangement shown in FIG. 3, the ink orifice 302C, ink channel 2C, and ink flow path 301C are arranged in a straight line. Alternatively, a so-called side-shooter type arrangement may be employed in which the orifice 302 is arranged opposite to the electrothermal transducers (heaters) 401.

It should be noted that, in FIG. 3, reference numeral 1 denotes a printhead substrate (hereinafter referred to as "head substrate") on which are formed electrothermal transducers and the variety of circuits that drive the electrothermal transducers to be described later, a memory, a variety of pads that form the electrical contacts with the carriage HC, and a variety of signal wires.

Moreover, one electrothermal transducer (heater), and the MOS-FET that drives it are together called a printing element, with a plurality of printing elements called a printing element portion.

Note that although FIG. 3 is a diagram showing a three-dimensional structure of a printhead IJHC that discharges one color ink (cyan ink) among a plurality of color inks, the structure is the same as that of the printhead that discharges the remaining color inks.

Next, a description is given of the control configuration for executing print control of the printing apparatus described above.

Figure 4:
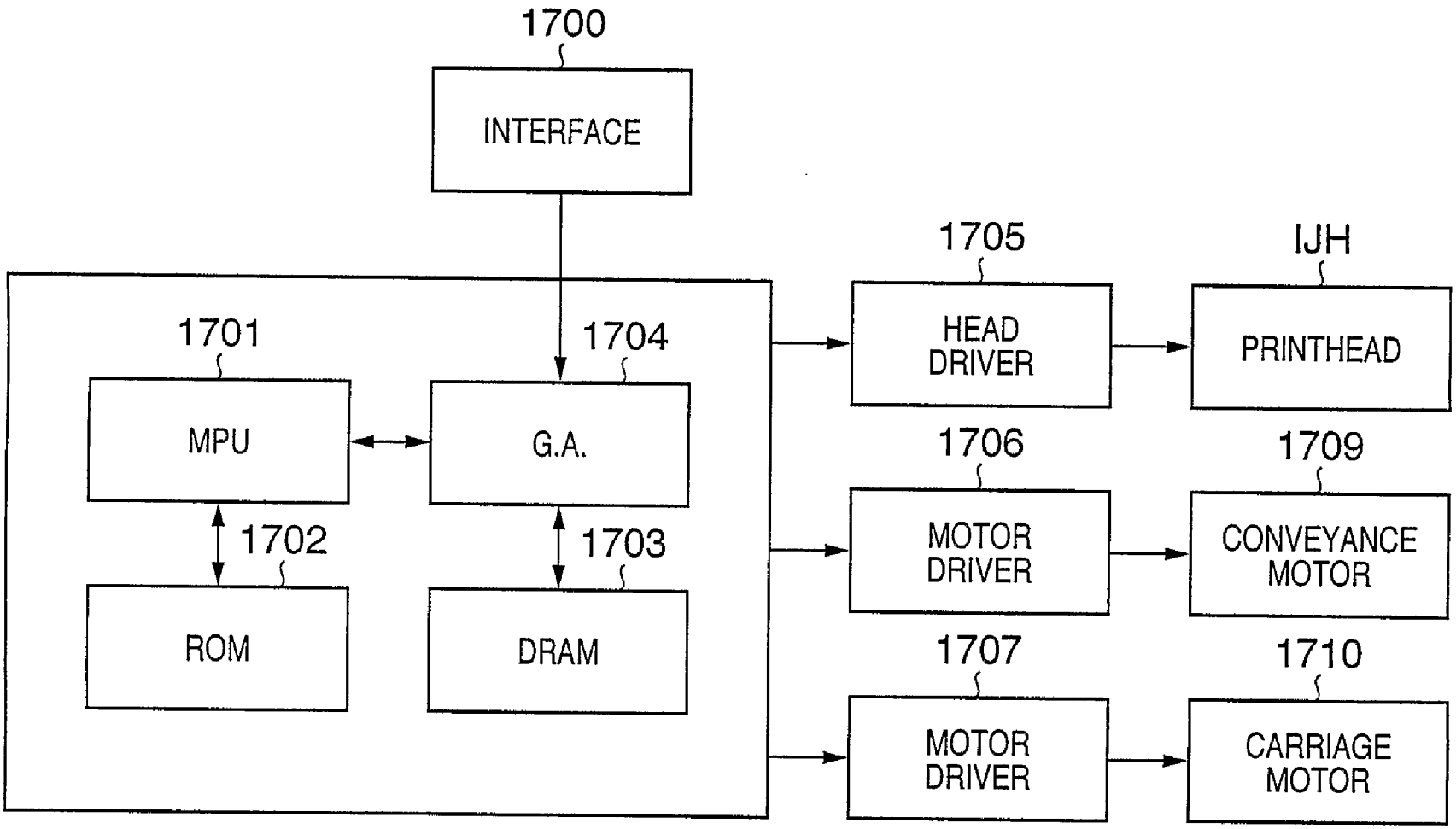
FIG. 4 is a block diagram showing the control arrangement of the printing apparatus shown in FIG. 1.

FIG. 4 is a block diagram showing the arrangement of a control circuit of the printing apparatus.

Referring to FIG. 4 showing the control circuit, reference numeral 1700 denotes an interface for inputting a printing signal; 1701, an MPU; 1702, a ROM for storing a control program executed by the MPU 1701; and 1703, a DRAM for storing various data (the printing signal, printing data supplied to the printhead, and the like). Reference numeral 1704 denotes a gate array (G.A.) for performing supply control of printing data to the printhead IJH. The gate array 1704 also performs data transfer control among the interface 1700, the MPU 1701, and the RAM 1703.

Reference numeral 1709 denotes a conveyance motor (not shown in FIG. 1) for conveying a printing sheet P. Reference numeral 1706 denotes a motor driver for driving the conveyance motor 1709, and reference numeral 1707 denotes a motor driver for driving the carriage motor 5013.

This head driver also outputs a signal (analog signal or logic signal) which serves as a control signal for making a constant electric current value to be supplied to a heater of the printhead IJH variable.

The operation of the above control arrangement will be described next. When a printing signal is input to the interface 1700, the printing signal is converted into printing data for a printing operation between the gate array 1704 and the MPU 1701. The motor drivers 1706 and 1707 are driven, and the printhead IJH is driven in accordance with the printing data supplied to the carriage HC, thus printing an image on the printing paper P.

The embodiment uses printheads having the arrangement as shown in FIG. 2, and they are controlled so that printing by the printhead IJHK and printing by the printhead IJHC do not overlap each other in each scanning of the carriage. In color printing, the printheads IJHK and IJHC are alternately driven in each scanning. For example, when the carriage reciprocally scans, the printheads IJHK and IJHC are so controlled as to drive the printhead IJHK in forward scan and the printhead IJHC in backward scan. Driving control of the printheads is not limited to this, and printing operation may be done in only forward scan and the printheads IJHK and IJHC may be driven in two forward scan operations without conveying the printing sheet P.

Several embodiment on the arrangement and operation of the head substrate integrated in the printhead IJH will be explained.

Several embodiments will be described for the arrangement and operation of the head substrate integrated in the printhead IJH.

First Embodiment

Figure 5:
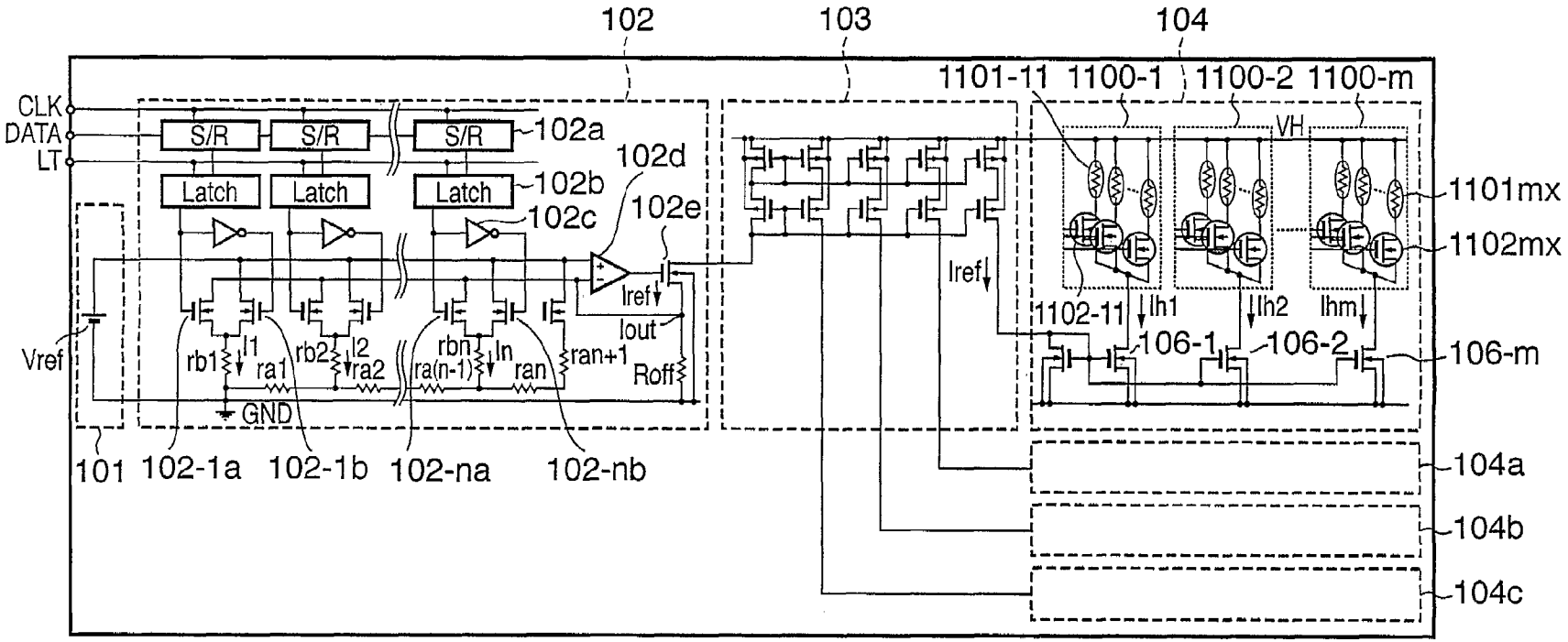
FIG. 5 is a circuit diagram showing an example of the arrangement of a head substrate integrated in a printhead IJH.

FIG. 5 is a circuit diagram showing an example of the arrangement of a head substrate integrated in a printhead IJH.

As shown in FIG. 5, the circuit of the head substrate is mainly comprised of a reference voltage circuit 101, current regulating circuit 102, reference current circuit 103, and constant electric current source block 104.

As also described in the conventional case, the first embodiment will explain about driving of a printhead having a total number of (x x m) heaters divided into m groups each having x heaters. The same reference numerals as those described in FIG. 13 of the conventional case denote the same building components, and a description thereof will be omitted.

In FIG. 5, the reference voltage circuit 101 generates the reference voltage (Vref) of the current regulating circuit 102. The reference voltage source is desirably an voltage source which outputs a stable voltage against changes in power supply voltage and temperature. For example, if the voltage source is a reference power source which uses the bandgap voltage, it is possible to provide a stable voltage against changes in power supply voltage and temperature. Since this reference power source uses a unique voltage based on characteristics of a semiconductor, it is hardly influenced by manufacturing variations.

The operation of the current regulating circuit 102 will be explained.

The current regulating circuit 102 generates a variable current output corresponding to digital input data on the basis of the reference voltage (Vref) serving as an output from the reference voltage circuit 101.

In the first embodiment, the basic voltage conversion arrangement adopts a digital-to-analog conversion circuit formed from an R-2R resistor array of a resistance value (R) and double the resistance value (2R) (details of which will be described later). However, the same effects can also be obtained by the arrangement of another digital-to-analog conversion circuit.

Note that the circuit arrangement according to this embodiment is desirable in view of a small circuit scale and high accuracy since it is composed of resistors and switching transistors.

The current regulating circuit 102 comprises two blocks: a serial-parallel conversion circuit made up of shift registers (S/Rs) 102*a* and latch circuits (Latches) 102*b*; and a variable current circuit made up of R-2R resistor arrays and MOS transistors.

The serial-parallel conversion circuit is formed from the shift registers (S/Rs) 102*a* which receive a data signal (DATA) from the external printing apparatus main body in synchronism with a clock signal (CLK), and the latch circuits (Latches) 102*b* which receive signals from the shift registers (S/Rs) 102*a*, which receives serially input signals, in synchronism with a latch signal (LT). The serial-parallel conversion circuit comprises n shift registers and n latch circuits in correspondence with the number of bits of a signal processed by the variable current circuit. The serial-parallel conversion circuit converts arbitrary serial input data into parallel data as latch outputs, and outputs the latch outputs to the variable current circuit.

The variable current circuit is formed from resistors and MOS transistors serving as switches. In this case, (n+1) resistors $r_{a1}$ to $r_{an+1}$ having a resistance value "R" are series-connected to each other with a ground terminal (GND) as one terminal. To the contrary, one terminal of each of resistors $r_{b1}$ to $r_{bn}$ having a resistance value "2R" double the resistance value of the resistors $r_{a1}$ to $r_{an+1}$ is connected to a corresponding one of the nodes of the resistors $r_{a1}$ to $r_{an}$, and the other terminal is connected to both the source of a corresponding one of MOS transistors 102-1*a* to 102-*na* and the source of a corresponding one of MOS transistors 102-1*b* to 102-*nb*.

The drains of the MOS transistors 102-1*a* to 102-*na* and 102-1*b* to 102-*nb* are respectively connected to a reference current output terminal (Iref) and reference voltage (Vref). The gates of the MOS transistors 102-1*a* to 102-*na* receive digital signals from the latch circuits 102*b*, whereas the gates of the MOS transistors 102-1*b* to 102-*nb* which are paired with the MOS transistors 102-1*a* to 102-*na* receive outputs prepared by inverting signals from the latch circuits 102*b* by inverters 102*c*.

The MOS transistors 102-1*a* to 102-*na* and 102-1*b* to 102-*nb* function as switches which close/open their source-drain paths, and are controlled by digital signals from the latch circuits 102*b*.

An operational amplifier 102*d* has a non-inverting input terminal (+) connected to the reference voltage (Vref) and the drains of the MOS transistors 102-1*b* to 102-*nb*, and an inverting input terminal (−) connected to the drain terminals of the MOS transistors 102-1*a* to 102-*na* and the source of an output MOS transistor 102*e*. The output of the operational amplifier 102*d* is connected to the gate of the output MOS transistor 102*e*. The drain of the MOS transistor 102*e* serves as the output terminal of the electric current (Iref), and the electric current (Iref) is output to the reference current circuit 103.

The inverting input terminal (−) of the operational amplifier 102*d* receives a source output from the output MOS transistor 102*e* so as to make the signal potential of the inverting input terminal (−) equal to the reference voltage (Vref) input to the non-inverting input terminal (+). An output from the operational amplifier 102*d* is input to the gate of the output MOS transistor 102*e* to control the source output of the output MOS transistor 102*e*. As a result, the reference voltage (Vref) is also applied to the drains of the MOS transistors 102-1*a* to 102-*na* connected to the inverting input terminal (−) of the operational amplifier 102*d*.

On the other hand, the reference voltage (Vref) is input to the drains of the MOS transistors 102-1*b* to 102-*nb*. As shown in FIG. 5, the MOS transistors 102-1*a* to 102-*na* and 102-1*b* to 102-*nb* are respectively paired, the gates of each pair of the MOS transistors are connected via the inverter 102*c*, and either MOS transistor of each of the MOS transistor pairs respectively connected to the resistors $r_{b1}$ to $r_{bn}$ is always ON.

Assuming that the resistances between the sources and drains when the MOS transistors 102-1*a* to 102-*na* and 102-1*b* to 102-*nb* are ON are negligible compared to the resistance values (2R) of the resistors $r_{b1}$ to $r_{bn}$, the reference voltage (Vref) is always applied to the terminals of the resistors $r_{b1}$ to $r_{bn}$ on one side via the MOS transistors 102-1*a* to 102-*na* or 102-1*b* to 102-*nb*.

Currents I1 to In flowing through the resistors $r_{b1}$ to $r_{bn}$ are I1=Vref/(2×R), I2=Vref/(2×2×R), . . . , and In =Vref/($2^n$×R).

Of the MOS transistors 102-1*a* to 102-*na*, MOS transistors corresponding to ON signals among digital input signals output a sum of corresponding electric currents out of the electric currents I1 to In to a current output terminal (Iout).

Since the electric currents I1 to In are weighted by ½ each, as described above, an electric current having $2^n$ values can be output from the current output terminal (Iout) in accordance with arbitrary digital signals input to the MOS transistors 102-1*a* to 102-*na*. In other words, the output reference current (Iref) can be changed in $2^n$ steps within the range of 0 to Vref/R.

By connecting a resistor Roff of a resistance value (R1) between the source of the MOS transistor 102*e* and GND, Vref can be applied across the resistor Roff to always supply an electric current Vref/R1. The offset Vref/R1 can be added to the variable range of the electric current, and the variable range of the reference current (Iref) can be set to Vref/R1 to Vref/R1+Vref/R.

As is apparent from FIG. 5, the reference current (Iref) and constant electric current sources 106-1 to 106-*m* form current mirror circuits, and the constant electric current sources 106-1 to 106-*m* output constant electric currents Ih1 to Ihm proportional to the reference current (Iref) on the basis of the reference current (Iref).

As described with reference to FIG. 13 of the conventional case, the constant electric current source block 104 comprises (x x m) heaters 1101-11 to 1101-*mx*, (x x m) switching elements (MOS transistors) 1102-11 to 1102-*mx*, and it further comprises the m electric current sources (constant electric current sources) 106-1 to 106-*m* corresponding to respective groups in this embodiment. These electric current sources change the value of an electric current to be supplied to heaters by changing the reference current. However, once the value is set, the set value is made constant regardless of the number of concurrently driven heater(s). Therefore, these electric current source are called "constant electric current sources".

As described with reference to FIG. 13, each switching element 1102-11 to 1102-*mx* controls supply/stop of an electric current to each element by a control signal from a control circuit (not shown) in accordance with an image signal used for printing. In this embodiment, each electrothermal transducer (heater) 1101-11 to 1101*mx* and each switching element 1102-11 to 1102*mx* in each group are series-connected, and these switching elements in each group are commonly connected to a corresponding one of the constant electric current source 106-1 to 106-*m* via a common connection wiring. The electrotheremal transducers are commonly connected to a power supply line VH (higher potential wiring side), GND terminals of the constant electric current sources 106-1 to 106-*m* are commonly connected to a ground line (lower potential wiring side).

By ON/OFF-controlling switching elements in each group in accordance with a control signal, the output currents Ih1 to Ihm are supplied to desired heaters from the constant electric current sources 106-1 to 106-*m* corresponding to the respective groups.

Figure 13:
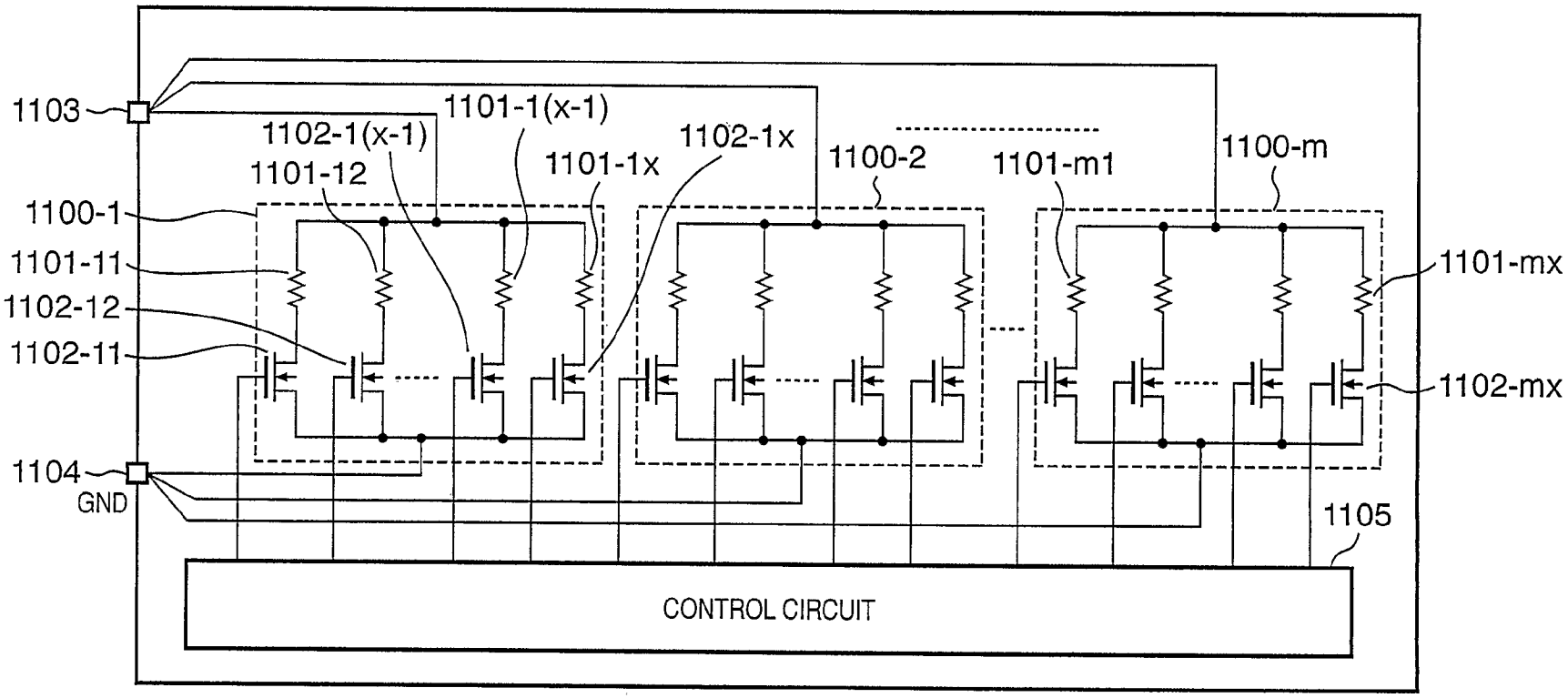
FIG. 13 is a circuit diagram showing an example of the arrangement of a heater driving circuit mounted in a conventional inkjet printhead.
Figure 14:
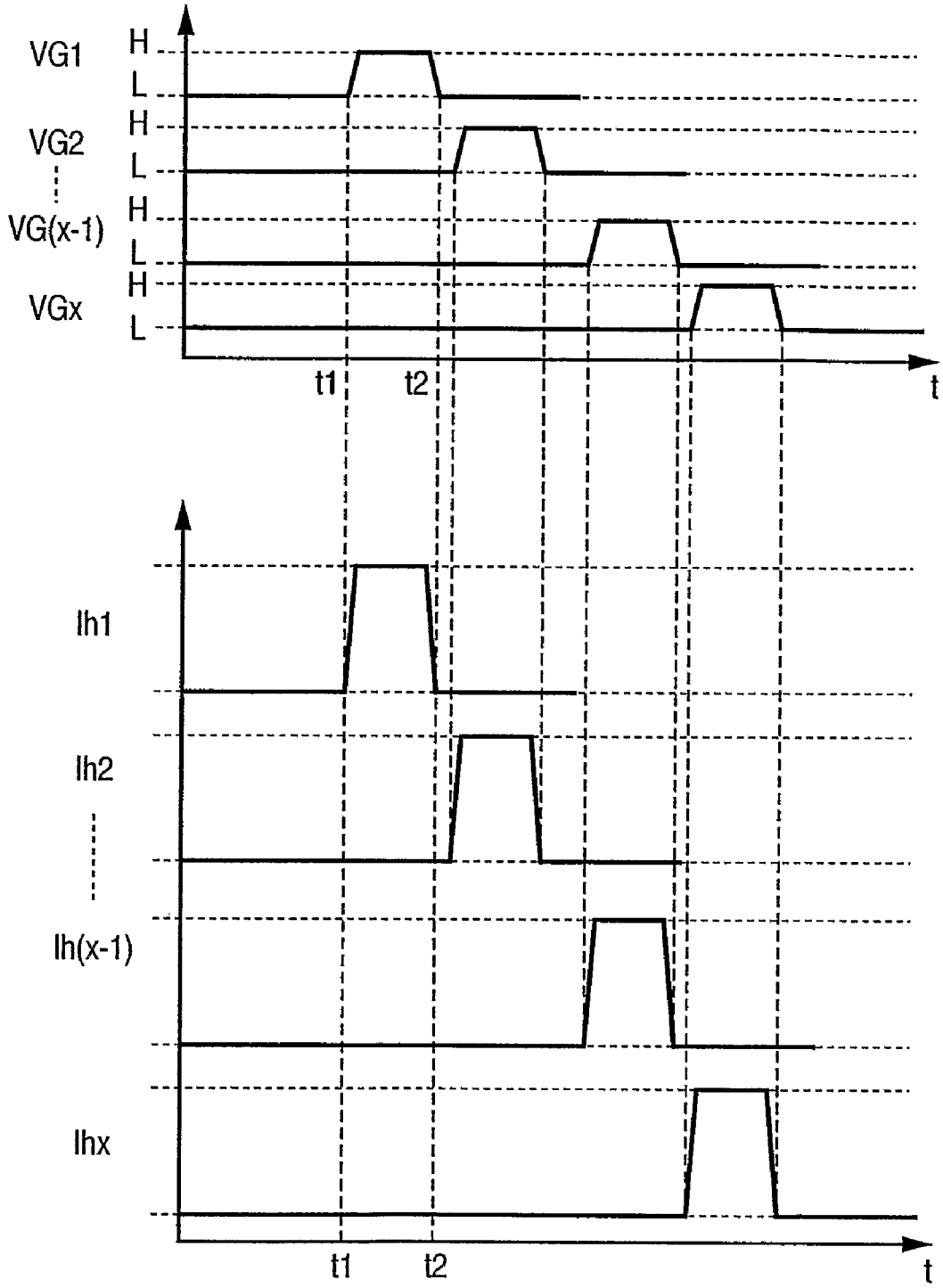
FIG. 14 is a timing chart showing a timing at which an electric current is sent to drive heaters in each group of the heater driving circuit shown in FIG. 13.
Figure 15:
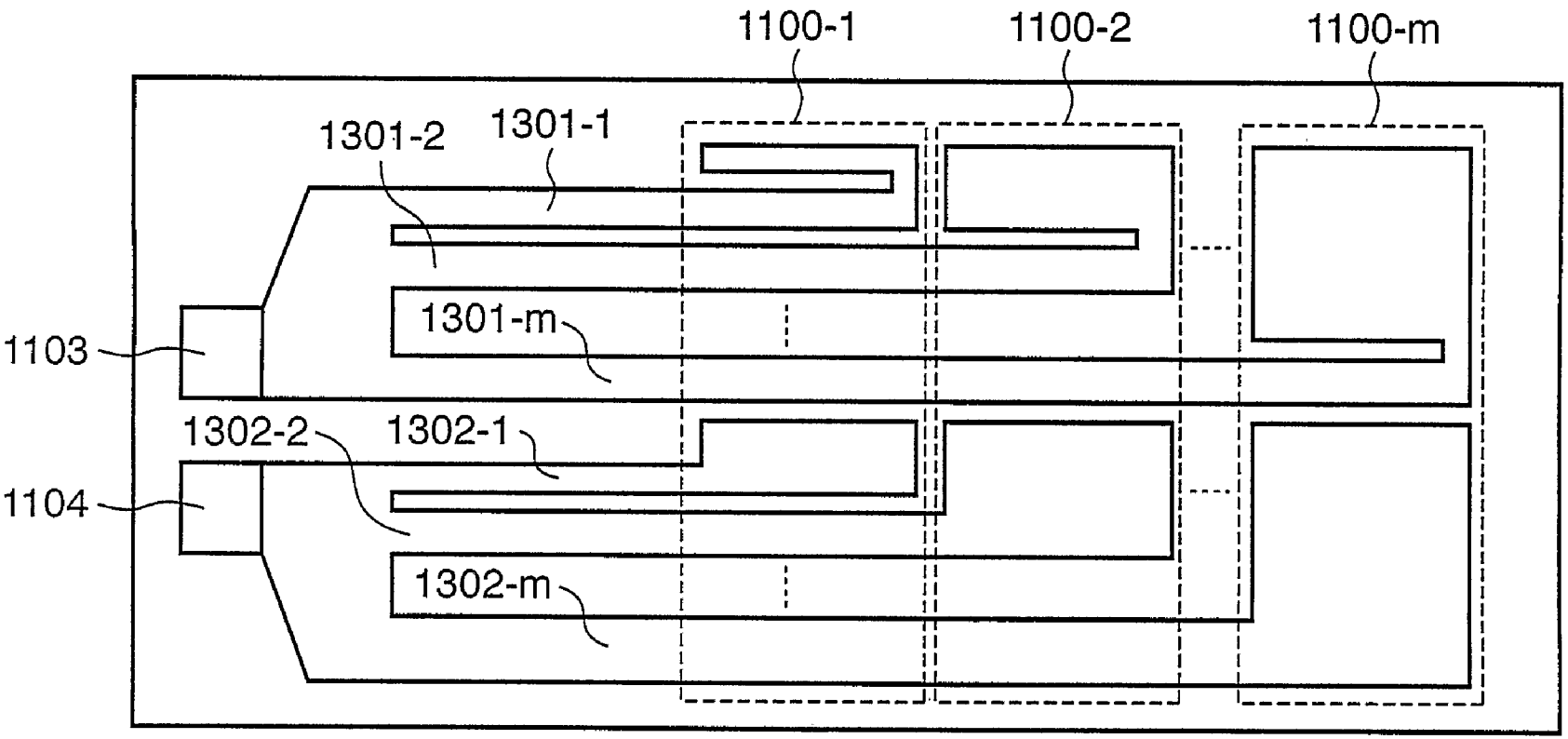
FIG. 15 is a view showing the layout of power supply lines connected from a power supply pad 1103 to groups 1100-1 to **1100-*m* shown in FIG. 13.
Figure 16:
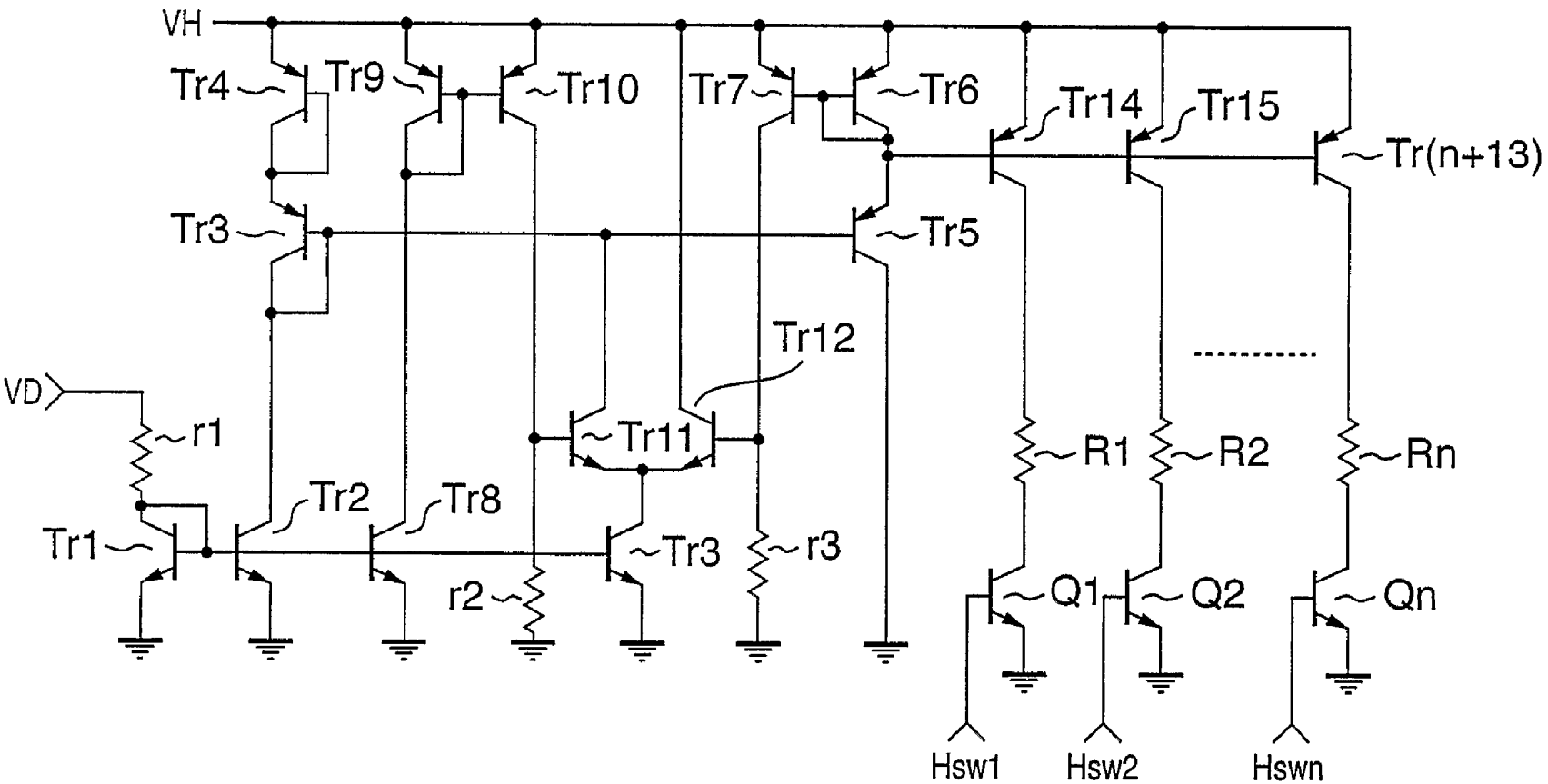
FIG. 16** is a circuit diagram showing a heater driving circuit according to the conventional art.

In FIG. 5, a MOS transistor is used as a switching element 1102-11 to 1102*mx*, and the gate terminal is connected to the control circuit, as described in the conventional case with reference to FIG. 13. Switching between the drain and source of the MOS transistor is controlled by a control signal from the circuit.

The arrangement where a heater and switching element which are series-connected are connected to a power supply line having a higher potential, and constant electric current sources are connected to a GND line having a lower potential can attain the following advantage.

More specifically, when the switching element 1102-*ij* (i=1,m; j=1,x) is OFF (open), the power voltage is not applied to a drain of the MOS transistor 106-*i* (i=1,m) used as a constant electric current source. On the other hand, when the switching element 1102-*ij* (i=1,m; j=1,x) is ON (closed), a high voltage is not applied to the drain of the MOS transistor 106-*i* (i=1,m) used as a constant electric current source due to the voltage drop since an electric current flows through a heater 1101-*ij* (i=1,m; j=1,x).

For this reason, a relatively poor-voltage-tolerant MOS transistor can be used as the MOS transistor serving as the constant electric current source, while a relatively high-voltage-tolerant MOS transistor must be used as the MOS transistor serving as the switching element. In other words, a simple structure MOS transistor produced from manufacturing process without any special process for enhancing a tolerance to a voltage is utilized for a MOS transistor serving as a constant electric current source.

The use of such MOS transistors contributes to reducing characteristic variations between the MOS transistors serving as constant electric current sources. This results in effectively reducing a variation of an output current.

According to an arrangement of the present invention, a constant electric current source and switching element are composed of separate transistors. Thus, the influence of the switching operation on a constant electric current is effectively suppressed.

Furthermore, according to the arrangement, a MOS transistor serving as a constant electric current source can be a low-voltage tolerant transistor as discussed above. Thus, the influence of the variation between the constant electric current sources is minimized.

Note that a MOS transistor operable in a saturated region where a variation of a drain current is smaller than that of a drain voltage may preferably be used as the constant electric current sources 106-1 to **106-*m***.

An arrangement where an ON (close)/OFF (open) control of an electric current flowing through a switching element and a heater in accordance with an image signal used for printing will be described here.

Figure 6:
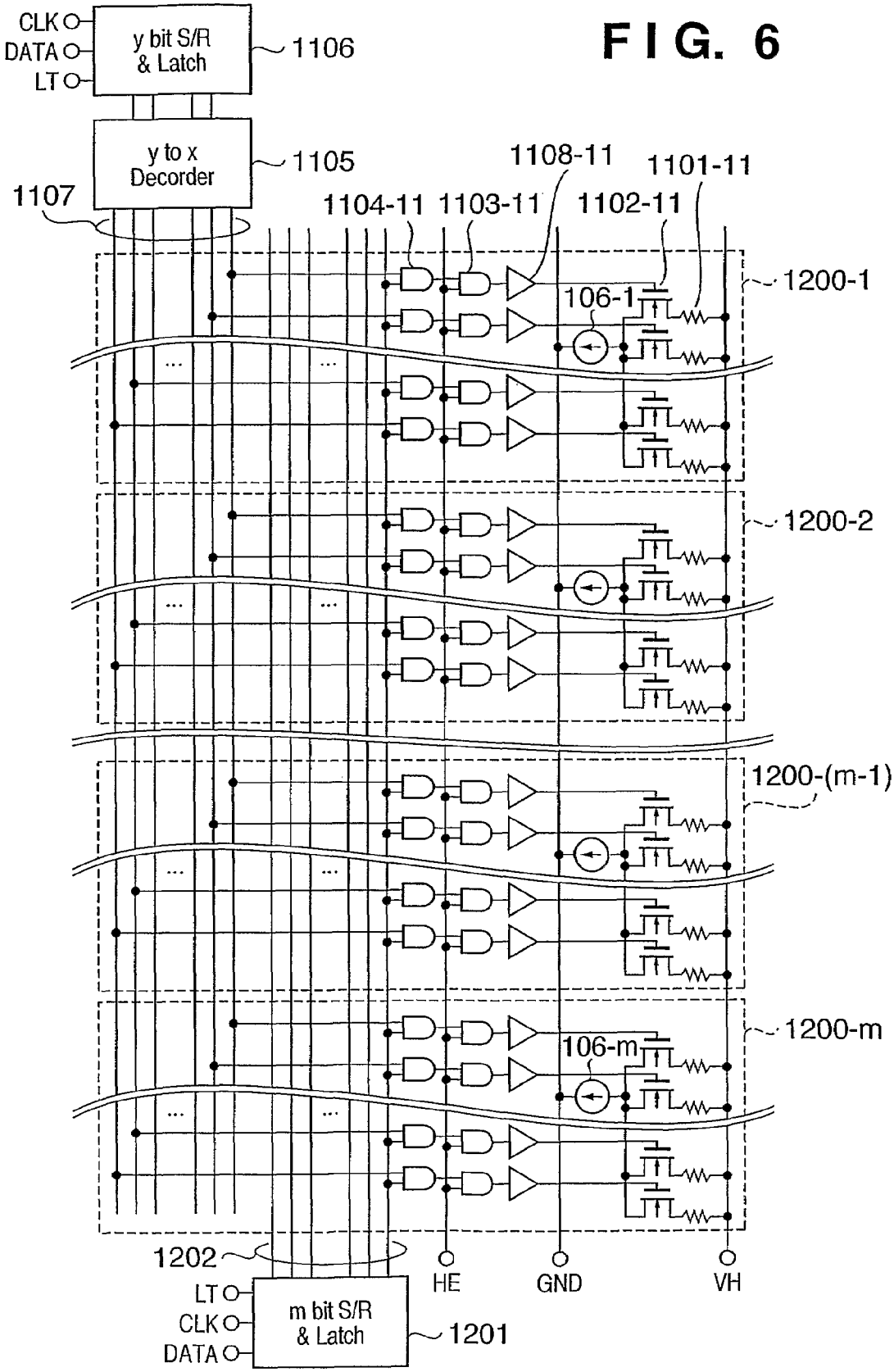
FIG. 6 is a circuit diagram showing an arrangement of a head substrate having (x x m) heaters which are time-divisionally driven at x-timings in unit of m substantially concurrently drivable heaters.

FIG. 6 is a circuit diagram showing an arrangement of a head substrate having (x x m) heaters which are time-divisionally driven at x-timings in unit of m substantially concurrently drivable heaters.

FIG. 6 particularly shows a specific example of an arrangement of a drive circuit of performing matrix drive by selecting any desired heater from a logical product (AND) of an output of a register storing M-bit data and X selection signals for concurrent driving unit. Note that, in FIG. 6, the same reference numerals as those described in the above denote the same building components, and a description thereof will be omitted.

In FIG. 6, numeral 1103-11 and 1104-11 denote first and second AND circuits for performing a logical product from logical signal inputs, respectively, and numeral 1105 denotes a Y to X decoder for decoding Y-bit control signals for concurrent driving unit selection supplied from a printing apparatus main body and selecting one of X concurrent driving unit selection signal lines 1107. Numeral 1106 denotes a Y-bit shift register (S/R) and Y-bit latch circuit for inputting Y-bit control signals (DATA) for concurrent driving unit selection serially transferred from the printing apparatus main body in synchronism with a clock signal (CLK) and latching these signals in synchronism with a latch signal (LT). Numeral 1108-11 denotes a voltage conversion circuit for converting a logic signal voltage into a voltage suitable to driving a gate of the MOS transistor 1102-11.

Note that the circuit arrangement shown in FIG. 6 includes (x x m) first AND circuits, (x x m) second AND, circuits, and (x x m) voltage conversion circuits corresponding to (x x m) heaters and (x x m) switching elements (MOS transistors). To refer to any of the respective elements, we use the following generic reference symbols in harmony with the circuit arrangement described below: **1103-*ij* (i=1,x; j=1,m) for the first AND circuit; 1104-*ij* (i=1,x; j=1,m) for the second AND circuit; and 1108-*ij*** (i=1,x; j=1,m) for the voltage conversion circuit.

As shown in FIG. 6, (x x m) heaters, (x x m) switching elements, (x x m) first AND circuits, (x x m) second AND circuits, and (x x m) voltage conversion circuits are grouped into m groups 1200-1 to **1200-*m*, each containing x heaters, x switching elements, x first AND circuits, x second AND circuits, and x voltage conversion circuits. Each group also contains a single constant electric current source 106-*i*** (i=1, m).

Numeral 1201 denotes a M-bit shift register (S/R) and M-bit latch circuit for inputting M-bit image signals for printing (DATA) serially transferred from the printing apparatus main body in synchronism with a clock signal (CLK) supplied from the printing apparatus main body and latching these serially input signals in synchronism with a latch signal (LT). M data signal lines 1202 come out from the M-bit shift register (S/R) and M-bit latch circuit 1201.

Each of X concurrent driving unit selection signal lines 1107 are connected to one input of one of X second AND circuits in each group. The other inputs of X second AND circuits are commonly connected within the same group, and one of M data signal lines 1202 is connected to the commonly connected line.

The operation of the circuit shown in FIG. 6 will be described in reference to a timing chart shown in FIG. 7.

Figure 7:
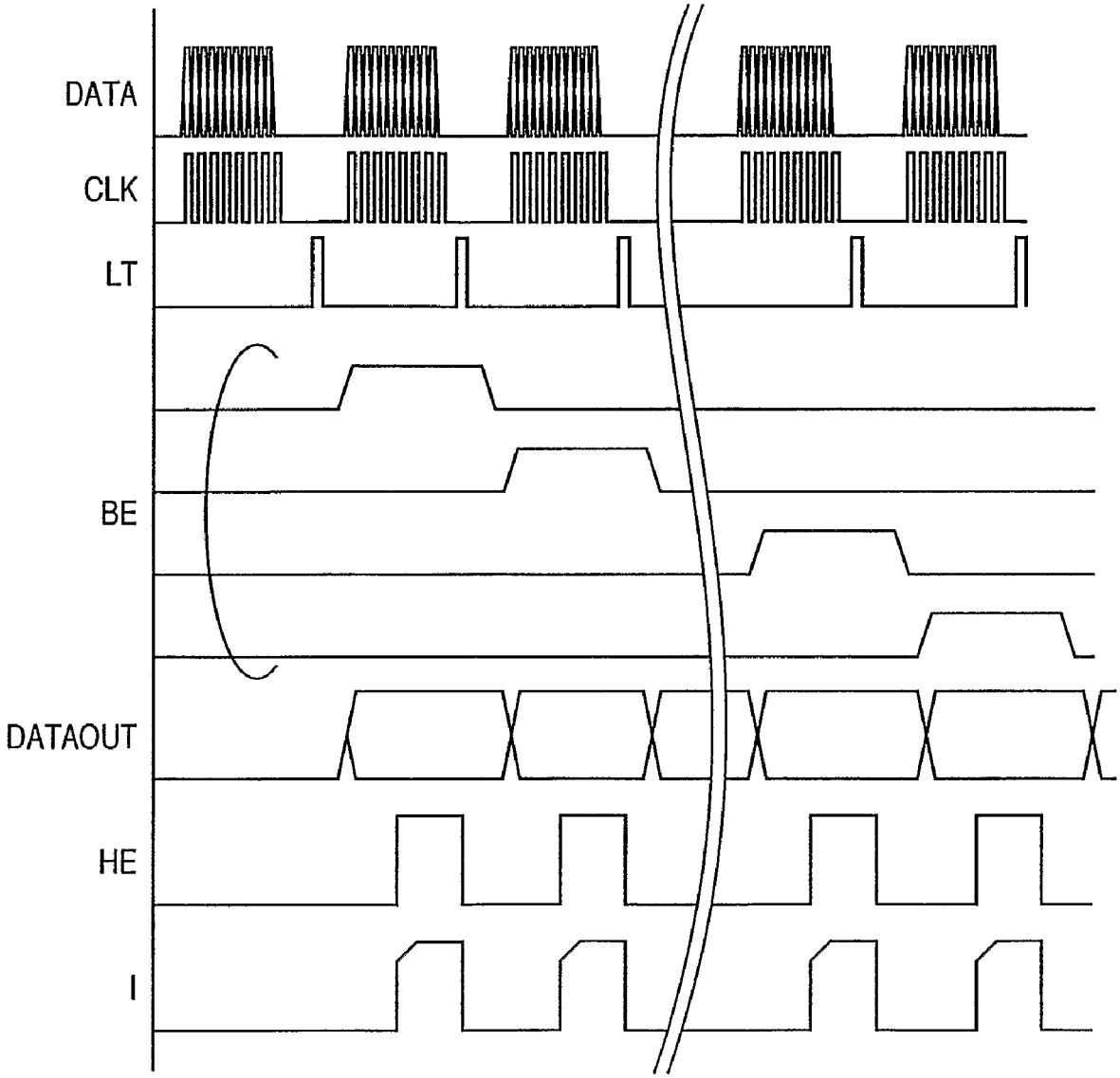
FIG. 7 is a timing chart showing a time-divisional driving sequence for one period.

FIG. 7 is a timing chart showing a time-divisional driving sequence for one period. During this period, each one of the (x x m) heaters is selected at most once. The time interval between one selection and the next selection for the same heater is defined as a period.

According to the time chart, M-bit image data is serially transferred as a data signal (DATA) to the M-bit shift register (S/R) and M-bit latch circuit 1201 in synchronism with a clock signal (CLK). When the latch signal (LT) is at a high level "H", the serially input signals are latched, and then these signals are outputted to the M data signal lines 1202. Such a signal output timing to the M data signal lines 1202 is represented as "DATAOUT" in FIG. 7. Signal levels in the M data signal lines 1202 become "H" in accordance with the M-bit image data.

Likewise, Y-bit control signals for concurrent driving unit selection is serially transferred as a data signal (DATA) to the Y-bit shift register (S/R) and M-bit latch circuit 1106 in synchronism with a clock signal (CLK). When the latch signal (LT) is at a high level "H", the serially input signals are latched, and then these signals are outputted to the Y to X decoder 1105.

A timing when the Y to X decoder 1105 outputs the decoded signal to X concurrent driving unit selection signal lines 1107 corresponds to an enable signal (BE) for selecting a concurrently drivable unit in FIG. 7. One of the X concurrent driving unit selection signal lines 1107 is selected by the Y-bit control signals for concurrent driving unit selection, and then the signal level of the selected line becomes "H".

The above operation results in selecting one heater which corresponds to both "H" at DATAOUT and "H" of the signal level of the selected line.

When a HE signal becomes "H", an electric current (I) flows through the selected heater. Then, the heater is driven.

By repeating the above operation x times, (x x m) heaters are time-divisionally driven at x-timings in unit of m heaters. In this way, all heaters are selected and driven in accordance with image data.

In other words, (x x m) heaters are grouped into m groups, each containing x heaters, one period is divided into x sub-periods so that two or more heaters within the same group are not concurrently driven, and at most M heaters, each belonging to a different group, are concurrently driven during one sub-period.

As shown in FIG. 6, a single constant electric current source **106-*i*** (i=1,m) is provided to each group. This means that a number of concurrently drivable heaters within one group is "one".

Figure 8:
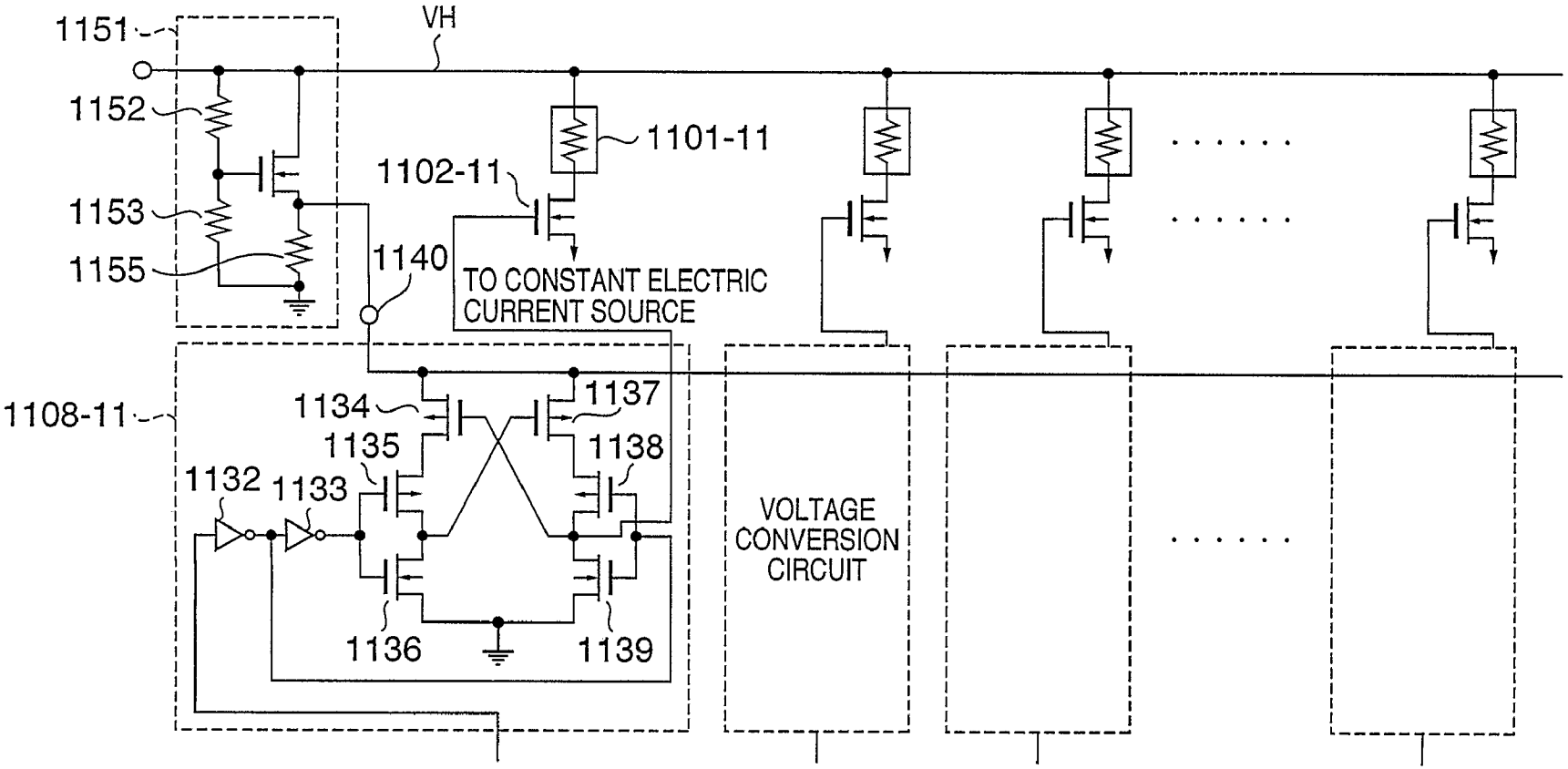
FIG. 8 is a circuit diagram showing an arrangement of the voltage conversion circuit 1108-11 used for driving a single heater.

FIG. 8 is a circuit diagram showing an arrangement of the voltage conversion circuit 1108-11 used for driving a single heater.

In FIG. 8, numeral 1151 denotes a voltage supply circuit for generating a voltage between a power supply line VH of the heater 1101-11 and a power supply line 1140 to the voltage conversion circuit 1108-11. The voltage supply circuit 1151 supplies a voltage common to a plurality of voltage conversion circuit **1108-*ij* (i=1,x; j=1,m). Numerals 1152, 1153 denote resistors; 1154: an n-MOS transistor; and 1155: a resistor connected to a source of the n-MOS transistor 1154. The n-MOS transistor 1154 and resistor 1155** form a source-follower type of buffer.

The ratio of partial potential of the resistor 152 to the resistor 153 creates any desired potential from the power supply line VH, the created potential is applied to the source-follower type of buffer composed of the n-MOS transistor 1154 and the resistor 1155, and the output from the source-follower circuit is finally applied to the voltage conversion circuit 1108-11.

Thus, according to this arrangement, a voltage suitable to the voltage conversion circuit is generated without providing any other power source.

Note that numerals 1134-1139 denote MOS transistors, and numeral 1132 and 1133 denote invertors.

On the head substrate shown in FIG. 5, an electric current can also be supplied from the reference current circuit 103 to three electric current source blocks 104*a*, 104*b*, and 104*c* having the same arrangement as that of the constant electric current source block 104. The electric current is supplied in accordance with the current mirror ratio of current mirror circuits formed in the reference current circuit 103.

Figure 10:
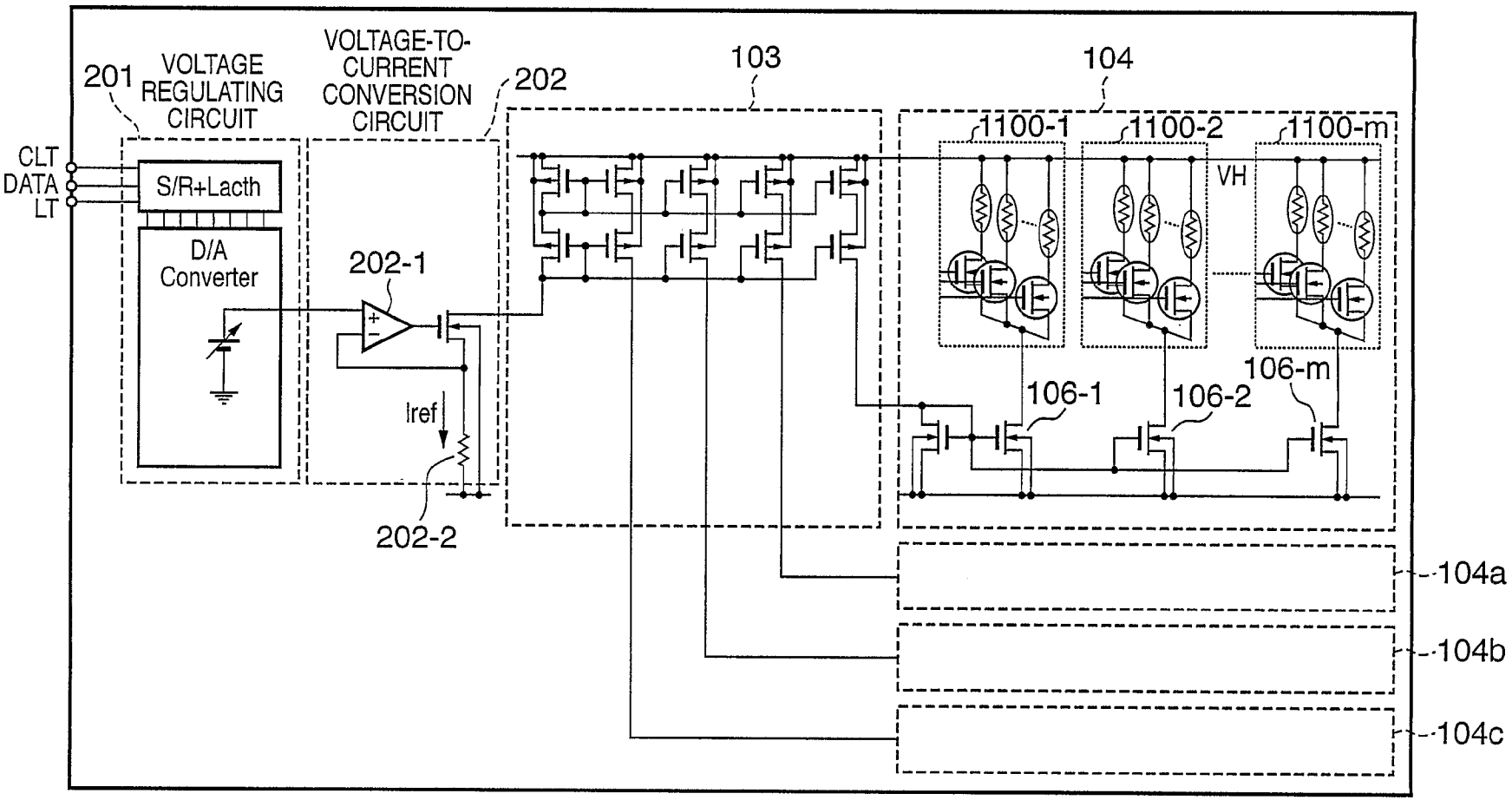
FIG. 10 is a circuit diagram showing the arrangement of a head substrate according to the second embodiment.
Figure 11:
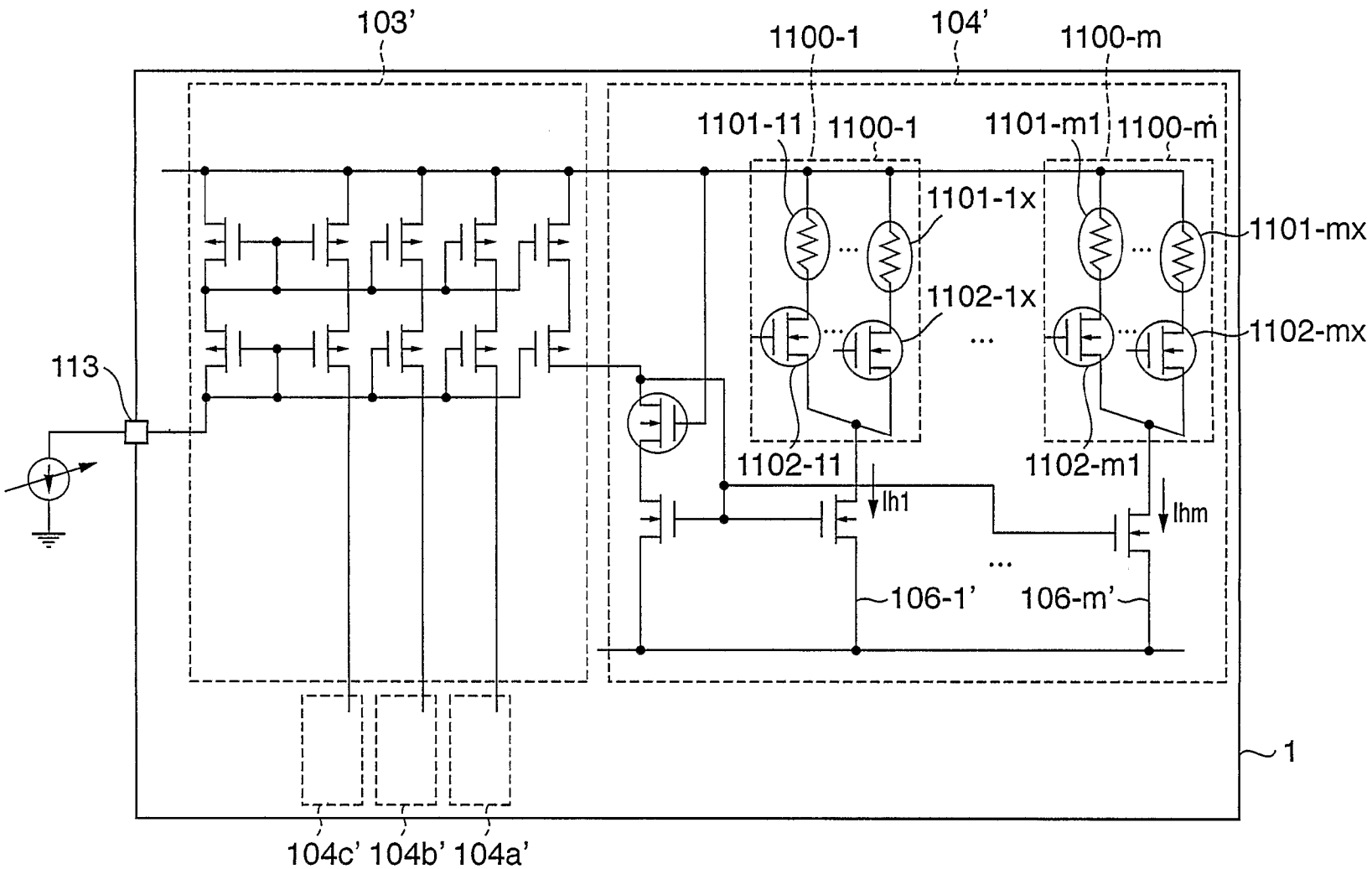
FIG. 11 is a circuit diagram showing the arrangement of a head substrate integrated in a printhead IJH according to the third embodiment.

Even in a case where a power supply voltage in the reference current circuit 103 shown in FIGS. 5, 10 and 11 is different from that in the constant electric current block 104 shown in FIGS. 5, 10 and 11, it is not necessary to provide an additional power source if a source follower output from the voltage supply circuit 151 shown in FIG. 8 is supplied as a power supply for the reference current circuit 103.

The arrangement shown in FIG. 5 can supply an electric current to the four constant electric current source blocks. The (x x m) heaters in these groups may be made to correspond to four nozzle arrays for discharging ink of the same color or four nozzle arrays for discharging inks of different colors.

The operation of the current regulating circuit 102 will be explained with reference to the timing chart of various input signals.

Figure 9:
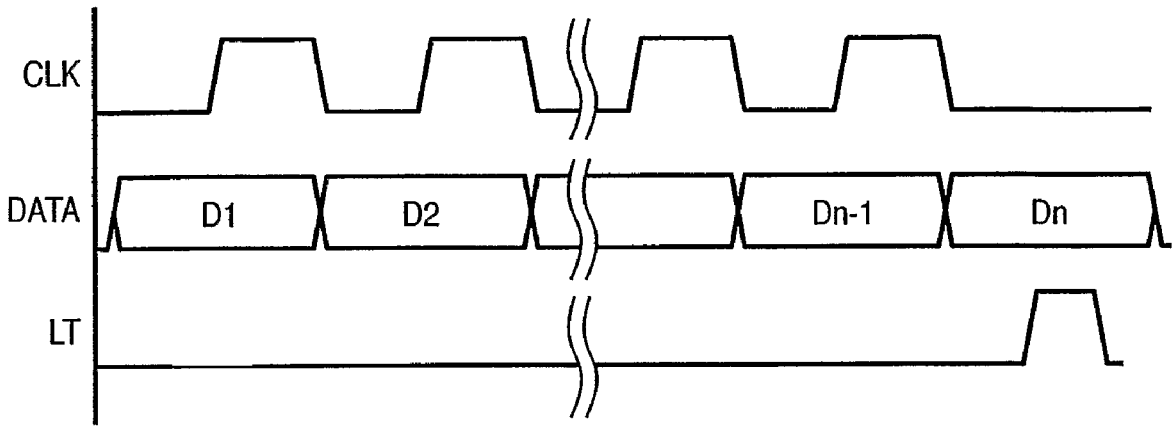
FIG. 9 is a timing chart showing signals supplied to the head substrate shown in FIG. 5.

FIG. 9 is a timing chart showing various signals input to the current regulating circuit 102.

FIG. 9 shows the input waveforms of a clock signal (CLK), data signal (DATA), and latch signal (LT). The timing chart represents the timings of one sequence for setting once a predetermined electric current value flowing through the heater.

In FIG. 9, serial data of n bits (D1, D2, D3, . . . , and Dn) are input by the data signal (DATA) in synchronism with the leading edge of the clock signal (CLK). The n-bit data signal (DATA) is input to the shift register in synchronism with n leading edges of the clock signal (CLK). When the latch signal (LT) changes to "H", the input data signal (DATA) of the n-bit data stored in the shift register is latched by the latch circuit, and the n-bit data is simultaneously output to the MOS transistors 102-1*a* to 102-*na* of the current regulating circuit 102.

The current regulating circuit 102 ON/OFF-controls the n MOS transistors 102-1*a* to 102-*na* in accordance with the n-bit data. An electric current obtained by adding a weighted electric current value output from a MOS transistor selected by the n-bit data serves as the reference current (Iref). The reference current is set once during a single sequence until the latch signal (LT) changes to "H" after the clock signal (CLK) and data signal (DATA) are input. The reference current value can be changed to a predetermined electric current value by inputting data corresponding to a desired electric current value and repeating the sequence.

As described above, the reference current (Iref) and constant electric current sources 106-1 to 106-*m* form current mirror circuits via the reference current circuit 103. The constant electric current sources 106-1 to 106-*m* respectively output the constant electric currents Ih1 to Ihm proportional to the reference current (Iref) on the basis of the reference current (Iref).

Printing is done by driving the (x x m) heaters of the electric current source block 104 via the switching elements (MOS transistors) which control supply/stop of an electric current in accordance with a control signal and printing signal from the control circuit of the printing apparatus main body.

According to the first embodiment described above, the electric current values Ih1 to Ihm supplied to heaters can be adjusted to a predetermined constant electric current value on the basis of information on the clock signal (CLK), data signal (DATA), and latch signal (LT) serving as logic signals input from the input terminal.

Second Embodiment

FIG. 10 is a circuit diagram showing the arrangement of a head substrate according to the second embodiment. In FIG. 10, the same reference numerals and same reference symbols as those described in FIG. 5 and the conventional case denote the same building components and signal lines, and a description thereof will be omitted.

The head substrate according to the second embodiment is mainly comprised of a voltage regulating circuit 201, voltage-to-current conversion circuit 202, reference current circuit 103, and constant electric current source block 104.

As is apparent from a comparison between this circuit and the circuit arrangement shown in FIG. 5, the second embodiment adopts a circuit arrangement in which a D/A converter modulates a voltage based on a reference voltage such as a bandgap voltage, while according to the arrangement shown in FIG. 5, a ladder circuit, comprised of the above-described (R-2R) resistor array serving as a D/A converter, modulates an electric current value, utilizing a constant voltage (Vref).

The value of the output voltage of the voltage regulating circuit 201 including a digital-to-analog conversion circuit (D/A converter) is controlled in accordance with input logic signals (clock signal (CLK), data signal (DATA), and latch signal (LT)), similar to the first embodiment. The voltage is applied to a resistor 202-2 via an operational amplifier 202-1 of the voltage-to-current conversion circuit 202.

Letting Vdac be the output voltage of the voltage regulating circuit 201 and Rref be the resistance value of the resistor 202-2, the reference current (Iref) is Iref=Vdac/Rref.

When the output voltage of the voltage regulating circuit has $2^n$ levels in accordance with a logic signal of n-bit data, as described in the first embodiment, the reference current (Iref) can also have $2^n$ levels.

According to the second embodiment, the current can be changed by the voltage regulating circuit and voltage-to-current conversion circuit on the basis of an input logic signal, and an electric current supplied to a printing element (heater) can be regulated, similar to the first embodiment.

Third Embodiment

FIG. 11 is a circuit diagram showing the arrangement of a head substrate 1 integrated in a printhead IJH.

In FIG. 11, the same reference numerals as those described in the first and second embodiments denote the same building components, and a description thereof will be omitted. A circuit arrangement including a VH wiring, electrothermal transducers (heater elements) 1101-11 to 1101-*mx*, switching elements 1102-11 to 1102-*mx*, constant electric current sources 106-1 to 106-*m*, and a GND wiring in this embodiment is the same as that described in the first embodiment.

The head substrate shown in FIG. 11 is comprised of an electric current source block 104' which supplies an electric current to heaters, and a reference current circuit 103' which generates an electric current serving as the reference current of the electric current source block.

A control terminal 113 of the reference current circuit 103' is connected to a terminal on the reference current (Iref) side in a current mirror circuit formed in the reference current circuit 103'. An electric current output from the current mirror circuit of the reference current circuit 103' serves as the reference current of the electric current source block 104'. The control terminal 113 of the current mirror circuit of the reference current circuit 103' receives an electric current from the outside of a printhead IJH (i.e., from a printing apparatus). The electric current output from the current mirror circuit of the reference current circuit 103' changes depending on an electric current value input from the outside of the heater.

Note that an electric current is supplied to the control terminal 113 from the outside of the printhead according to the third embodiment, but may be input from the printhead IJH or another circuit on the head substrate other than a case where the electric current is supplied from the outside of the printing apparatus or the like. In this case, the control terminal does not have a terminal shape but includes a mere wiring line.

Together with constant electric current sources 106-1' to **106-*m*' corresponding to m groups each formed from x heaters, the electric current source block 104' constitutes current mirror circuits which use an electric current output from the reference current circuit 103' as a reference. Electric currents Ih1 to Ihm output from the constant electric current sources 106-1' to 106-*m*' depend on an electric current output from the reference current circuit 103'**.

As described with reference to FIG. 13 of the conventional case, the electric current source block 104' comprises m groups each formed from x heaters, i.e., (x x m) heaters 1101-11 to **1101-*mx*, switching elements (MOS transistors) 1102-11 to 1102-*mx* equal in number to the heaters 1101-11 to 1101-*mx*, and the constant electric current sources 106-1' to 106-*m*' provided to the respective m groups. The switching elements 1102-11 to 1102-*mx*** control supply/stop of an electric current between the terminals in accordance with a control signal and printing signal supplied from the control circuit of the printing apparatus main body.

As shown in FIG. 11, the output terminals of the constant electric current sources 106-1' to **106-*m*' arranged for m groups 1100-1 to 1100-*m* are respectively connected to the common connection terminals of the groups in each of which x heaters and x switching elements are series-connected to each other. In controlling an electric current sent to each heater, the electric currents Ih1 to Ihm output from the constant electric current sources 106-1' to 106-*m*' arranged for the respective groups can be input to desired heaters by switching the switching elements 1102-*i*1 to 1102-*ix*** (i=1, m) of each group in accordance with a control signal (not shown).

On the head substrate shown in FIG. 11, an electric current can also be supplied from the reference current circuit 103' to three electric current source blocks **104*a*', 104*b*', and 104*c*' having the same arrangement as that of the electric current source block 104'. The electric current is supplied in accordance with the current mirror ratio of current mirror circuits formed in the reference current circuit 103'**.

The arrangement shown in FIG. 11 can supply an electric current to the four electric current source blocks. The (x x m) heaters in these groups may be made to correspond to four nozzle arrays for discharging ink of the same color or four nozzle arrays for discharging inks of different colors.

According to the third embodiment described above, the electric current values Ih1 to Ihm supplied to heaters can be regulated by controlling an electric current input to the control terminal of the reference current circuit.

Fourth Embodiment

Figure 12:
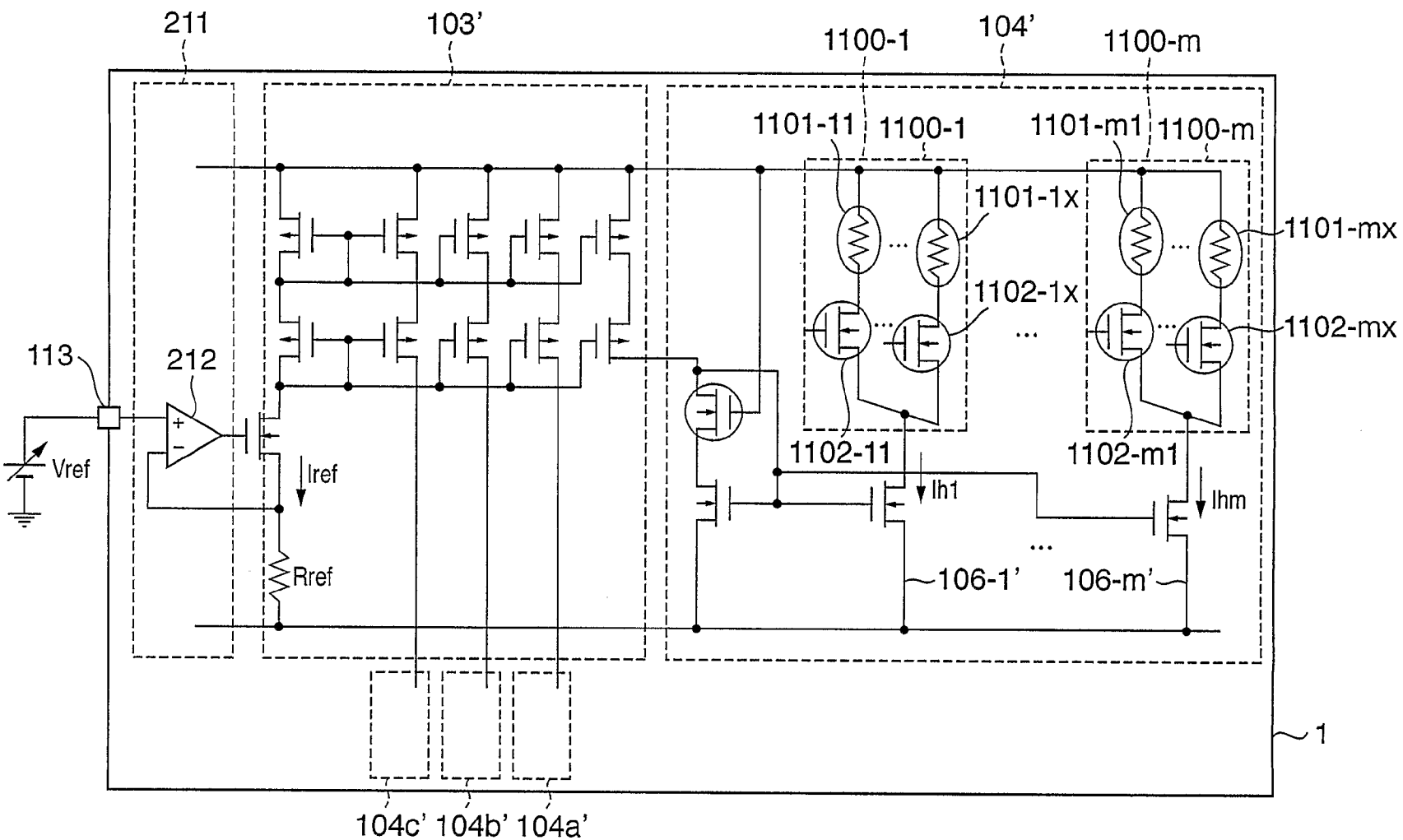
FIG. 12 is a circuit diagram showing the arrangement of a head substrate according to the fourth embodiment.

FIG. 12 is a circuit diagram showing the arrangement of a head substrate according to the fourth embodiment. In FIG. 12, the same reference numerals and same reference symbols as those described in FIGS. 5 and 11 denote the same building components, and a description thereof will be omitted.

As is apparent from a comparison between FIGS. 12 and 11, the fourth embodiment interposes a voltage regulating circuit 211 between the control terminal 113 and the reference current circuit 103' in the circuit of the above-described embodiment.

The operation of the voltage regulating circuit 211 will be explained.

A voltage input from the outside of a printhead IJH is applied to the terminal (+) of an operational amplifier 212 of the voltage regulating circuit 211 via the control terminal 113, and the voltage is applied to a resistor (Rref) via the operational amplifier 212. Letting Vref be a voltage input to the control terminal 113, an electric current (Iref) flowing through the resistor (Rref) is Iref=Vref/Rref.

The electric current (Iref) is equivalent to an electric current input from the outside of the printhead IJH that is described in the above embodiments. A reference current value input to the reference current circuit can be changed by changing Vref.

According to the fourth embodiment described above, an electric current supplied to the heater can be regulated by controlling a voltage input to the control terminal from the outside of the printhead, similar to the third embodiment.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-158030 filed on May 27, 2004 and Japanese Patent Application No. 2004-158031 filed on May 27, 2004, the entire contents of which are incorporated herein by reference.

The invention claimed is:

1. A printhead substrate comprising:

a plurality of printing elements;

a constant electric current source which generates a constant electric current used to drive said plurality of printing elements;

a reference current generation circuit which generates in accordance with an externally input logic signal a reference current for generating the constant electric current; and a driving circuit which drives said plurality of printing elements by the constant electric current obtained by driving said constant electric current source in accordance with the reference current generated by said reference current generation circuit, wherein said reference current generation circuit includes:

an n-bit shift register which receives and temporarily stores an n-bit logic signal;

a latch circuit which latches the n-bit logic signal stored in the n-bit shift register;

n driving circuits which generate electric currents of different levels; and an output circuit which outputs as the reference current a sum of the electric currents generated by the n driving circuits, and wherein the n driving circuits are selectively driven in accordance with the n-bit logic signal output from the latch circuit.

2. The printhead substrate according to claim 1, wherein said plurality of printing elements include a plurality of heaters and driving elements which are arranged in correspondence with the respective heaters and drive the heaters;

wherein the plurality of heaters and the driving elements are divided into a plurality of groups; and wherein said constant electric current source which supplies the constant electric current is arranged in correspondence with each group.

3. The printhead substrate according to claim 1, wherein the levels of the electric currents generated by the n driving circuits are weighted by ½ each in a descending order from a maximum level of the electric current, and the reference current as the sum of the electric currents is changeable at $2^n$ levels.

4. The printhead substrate according to claim 1, wherein said reference current generation circuit and said constant electric current source form a current mirror circuit.

5. The printhead according to claim 1, wherein the constant electric current source is comprised of a MOS transistor operable in a saturated region where a variation of a drain current is smaller than that of a drain voltage.

6. The printhead substrate according to claim 1, further comprising switching elements, wherein the printing elements, the switching elements and the constant electric current sources in order are arranged in a direction of a higher potential wiring to a lower potential wiring.

7. A printhead comprising a printhead substrate according to claim 1.

8. The printhead according to claim 7, wherein the printhead includes an inkjet printhead which prints by discharging ink.

9. A head cartridge integrating an inkjet printhead according to claim 8 and an ink tank containing ink to be supplied to the inkjet printhead.

10. A printing apparatus comprising an inkjet printhead according to claim 8 or a head cartridge according to claim 9 for discharging ink onto a printing medium for printing.

11. A printhead substrate comprising:

a plurality of printing elements;

a constant electric current source which generates a constant electric current used to drive said plurality of printing elements;

a reference current generation circuit which generates in accordance with an externally input logic signal a reference current for generating the constant electric current; and a driving circuit which drives said plurality of printing elements by the constant electric current obtained by driving said constant electric current source in accordance with the reference current generated by said reference current generation circuit, wherein said reference current generation circuit includes:

an n-bit shift register which receives and temporarily stores an n-bit logic signal;

a latch circuit which latches the n-bit logic signal stored in the n-bit shift register;

a voltage regulating circuit which is configured to output voltages of $2^n$ levels in accordance with the n-bit logic signal output from the latch circuit; and a voltage-to-current conversion circuit which converts the voltage from the voltage regulating circuit and outputs the reference current.

* * * * *